US006575665B2

(12) United States Patent
Richter et al.

(10) Patent No.: US 6,575,665 B2
(45) Date of Patent: Jun. 10, 2003

(54) PRECAST MODULAR MARINE STRUCTURE & METHOD OF CONSTRUCTION

(75) Inventors: Kirk T. Richter, Boerne, TX (US); Moon A. Fahel, San Antonio, TX (US)

(73) Assignee: H. B. Zachry Company, San Antonio, TX (US)

( * ) Notice: Subject to any disclaimer, the term of this patent is extended or adjusted under 35 U.S.C. 154(b) by 0 days.

(21) Appl. No.: 09/876,362

(22) Filed: Jun. 7, 2001

(65) Prior Publication Data

US 2001/0036387 A1 Nov. 1, 2001

Related U.S. Application Data

(63) Continuation-in-part of application No. 09/308,019, filed as application No. PCT/US97/21053 on Nov. 12, 1997, now Pat. No. 6,244,785.

(60) Provisional application No. 60/256,907, filed on Dec. 18, 2000, provisional application No. 60/044,359, filed on Apr. 29, 1997, and provisional application No. 60/030,583, filed on Nov. 12, 1996.

(51) Int. Cl.[7] ..... E02D 23/00; E02D 27/24; E02D 29/00

(52) U.S. Cl. ..... 405/195.1; 405/223.1; 405/224; 114/264; 114/265; 114/125

(58) Field of Search ..... 405/195.1, 223.1, 405/224.1; 114/125, 264, 265, 224

(56) References Cited

U.S. PATENT DOCUMENTS

| | | | | |
|---|---|---|---|---|
| H611 H | * | 4/1989 | Peace | 114/264 |
| 5,558,467 A | | 9/1996 | Horton | |
| 5,636,943 A | | 6/1997 | Haney | |
| 6,092,483 A | | 7/2000 | Allen et al. | |
| 6,206,614 B1 | * | 3/2001 | Blevins et al. | 405/224 |
| 6,210,075 B1 | | 4/2001 | Korloo | |
| 6,227,137 B1 | | 5/2001 | Allen et al. | |
| 6,263,824 B1 | | 7/2001 | Balint et al. | |

OTHER PUBLICATIONS

Blanchet et al. "Comparision Between Hibernia and the West Bonne Bay Concrete Gravity Based Structure Concept, ", OTC 11022, paper presented at the Offshore. Technology Conference, Houston, Texas, May 3–6, 1999.

* cited by examiner

*Primary Examiner*—Thomas B. Will
*Assistant Examiner*—Alexandra K. Pechhold
(74) *Attorney, Agent, or Firm*—Royston Rayzor Vickery & Williams LLP; William P. Glenn, Jr.

(57) ABSTRACT

A precast, modular marine structure and method of constructing the same for offshore use, including but not limited to drilling, oil and gas production, and oil storage in a variety of water depths. The marine structure includes an equalized pressure system and concrete modular components cast with at least one cell and a central longitudinal passageway. The equalized pressure system fluidly connects the cell(s) to the adjacent body of water by at least one substantially vertical segmented water column to equalize the hydrostatic pressure differential experienced at a wall of the marine structure. A truss section may be attached to the concrete portion of the marine structure to form a truss spar. A mooring and tether system may be included to maintain the marine structure's station and attitude. Construction of a marine structure includes assembly line techniques to form and cast individual modular components (such as a segment or module) in a position which encourages the pouring and curing of a concrete slurry; slipping the modular component from its form; translating the modular component into a position for mating with other modular components; and mating and connecting modular components with tendons to achieve a unitary marine structure.

29 Claims, 20 Drawing Sheets

Sectional View

Truss Removed

Bottom View

Top View

EPS ( Evacuating Water )

EPS ( Operating Condition )

PRECAST MODULAR MARINE STRUCTURE & METHOD OF CONSTRUCTION

CROSS REFERENCE

This application is a continuation in part of U.S. application Ser. No. 09/308,019, filed May 12, 1999, now U.S. Pat. No. 6,244,785, which was the national stage of International Application No. PCT/US97/21053, filed Nov. 12, 1997 which claims the benefit of Provisional Application No. 60/030,583 filed Nov. 12, 1996; and Provisional Application No. 60/044,359, filed Apr. 29, 1997. This application further claims the benefit of Provisional Application No. 60/256,907 filed Dec. 18, 2000. None of the cross references set forth above are admitted to be prior art with respect to the present invention by its mention in the cross reference and background sections. Furthermore, the entire disclosures of the previous application are to be considered a part of this disclosure and is hereby incorporated by reference.

TECHNICAL FIELD

The present invention relates to an apparatus, namely a marine structure incorporating at least one modular spar for use in a body of water, such as the Gulf of Mexico, the North Sea or the South Atlantic Ocean. The present invention further relates to a marine structure incorporating an equalized pressure system to adjust the internal pressure of the structure in relation to an external hydrostatic pressure exerted thereupon. Additionally, the present invention relates to a method of constructing precast modular marine structures.

BACKGROUND OF THE INVENTION

Much of the World's production of oil and gas is derived from offshore wells. While the early offshore oil and gas fields were located in relatively shallow water, the need to develop oil fields in deep water has become more important as the shallow water oil and gas fields become depleted. As a result, many deep-water basins throughout the world have been opened to oil and gas exploration and drilling.

During the exploration for, and production of sub-sea resources like oil and gas, an array of marine vessels, structures and appurtenances are employed. Prior proposed vessels used for exploration, drilling, production and storage of oil and gas at sea included: ships, boats, mobile offshore drilling units, semi-submersible units, submersible units, jack-up rigs, platforms, spars, deep draft caisson vessels, tension leg platforms and various combination of these and other components often in conjunction with a riser or sub-sea system.

Platforms, spars, deep draft caisson vessels, and tension leg platforms typically include a long vertical cylindrical hull that supports a platform above the water line. The platform provides space for drilling and maintaining oil or gas wells where the production wells may be positioned along an outside edge of the platform. Alternatively, the production wells may be located in the center of the platform within a moon bay or pool. Likewise, the above water platform of such a marine structure can be configured for use such as a launch pad for aeronautical and space vehicles, housing, hotels, resorts, and manufacturing and processing facilities.

Generally, traditional construction methods and materials for marine structures, including platforms, spars, deep draft caisson vessels, tension leg platforms, jack-up rigs, semi-submersible units, mobile offshore drilling units, ships and boats require the erection of frames about which plates, planks or sheets of material such as metal, wood or resin impregnated cloth are faired by and attached (permanently or otherwise) to the frames by skilled labor to form a complete or at least a significant portion of the marine structure's hull. Thereafter, the marine structure is launched or introduced into the water for further outfitting or operation.

Traditional materials of metal and/or wood require fairing, fixing and supporting the material(s) between frames. However, due to limitations in the structural and strength characteristics of traditional construction materials and the lack of economical labor with the proper skills, alternative construction methods have been developed. For example, the world's first metal oil/gas production spar hull was constructed as two separate sections in Finland. The two separate sections were shipped across the Atlantic Ocean aboard heavy lift vessels until reaching the Gulf of Mexico. There, the two separate sections of the spar hull were brought back to shore and welded together. The entire welded hull was then towed horizontally to the project site and upended to the vertical position by filling its lower ballast tanks with water.

Marine structures, such as the Troll A Platform, have been constructed from concrete materials using the slip form construction technique. This technique typically calls for the pouring of concrete in a vertically movable form. The form is connected to jack rods with hydraulic jacks, which move the form vertically in minute increments as the concrete is being poured. Once pouring begins, it continues until the top of the structure is reached, allowing for a monolithic poured concrete structure. Utilizing the slip form construction technique for marine structures requires a transportation path of sufficient clearances (in terms of water depth and overhead clearances) to accommodate the vertical monolithic poured structure. Furthermore, the scantlings of the lower regions of the pour must be of sufficient strength to accommodate the weight of the upper regions of the structure while being poured.

The structural sections may include either plated hull tank sections, or a combination of tank and truss-type section. An example of suchspar platforms is depicted in U.S. Pat. No. 5,558,467 issued on Sep. 24, 1996 to Horton (hereinafter Horton '467). The Horton '467 patent describes a hull having a passage longitudinally extending through the hull in which risers run down to the sea floor. However, the Horton '467 patent fails to provide for a precast modular marine structure or incorporation of an equalized pressure system that adjusts internal pressure of the structure in relation to external pressure, namely hydrostatic pressure, exerted thereupon.

An alternative design of an existing spar platform is depicted in U.S. Pat. No. 5,875,728 issued on Mar. 2, 1999 to Ayers, et al. (hereinafter Ayers '728). The Ayers '728 patent provides for a spar platform incorporating an essentially vertical cylindrical buoyant vessel and a shroud surrounding the vessel. The shroud includes two intersecting sets of foam-filled fiberglass elements that are secured to the vessel using standoffs. Nevertheless, the Ayers '728 patent neither describes nor claims a precast modular marine structure or incorporation of an equalized pressure system, which gives the structure the ability to withstand an increasing hydrostatic force as the water depth increases.

Without an equalized pressure system, a spar system and any other marine structure requires additional reinforcement to withstand the significant hydrostatic forces. Such structures, including spars, risers, tension legs, and buoyancy cans must include greater wall thickness; stronger, lightweight materials; pressure resistant shapes; pre-pressurization of the structure and combinations of these techniques, especially when operating water depth increases. Utilizing the greatest wall thickness to withstand the maximum hydrostatic pressure over the complete depth of operation of the marine structure results in a simplified construction, but with a significant increase in weight and limit upon the ultimate water depth at which the marine structure can operate. A significant weight reduction can be achieved by varying the wall thickness in relation to the depth of water. Such a solution, however, significantly increases the complexity and cost to construct the marine structure, yielding only a modest increase in the limit of the ultimate operating water depth. The same result is true with the use of stronger lightweight materials, different shapes or combinations of the same. Each of these approaches use the strength of the construction material to withstand the hydrostatic pressure exerted on the external surface or wall of a typically hollow, closed marine structure.

Another known solution requires an increase in the internal pressure of the marine structure to a pressure that approximates the hydrostatic pressure that will be experienced at the depth at which the structure is planned to be operated. The obvious goal is to significantly reduce or eliminate the pressure differential experienced at the marine structure's wall. One approach is to pre-pressurize the marine structure, or compartments thereof, in order to eliminate or significantly reduce the pressure differential that will be experienced once the marine structure is located in its operational position. As can be appreciated, pre-pressurization calls for designing the marine structure to be, in effect, a pressure vessel with a positive pressure contained inside until finally positioned at the prescribed depth. This pre-pressurization requires increased wall thickness and presents a potential safety hazard because of the often-high pressures that must be contained within the vessel during handling prior to, and during installation. One method of delaying pre-pressurization is contemplated in U.S. Pat. No. 5,636,943 issued on Jun. 10, 1997 to Haney (hereinafter Haney '943). According to Haney '943, gas is automatically generated on the inside of the tubular member as the structure descends to its optimal location. However, gas generation is dependent upon the consumption of pre-installed chemicals and a one-time reaction involving such chemicals.

In view of the above-described complexities associated with the design and use of known marine structures, which by their nature were usually designed and constructed to withstand significant internal-external pressure differentials across an outer wall or hull, the present invention has been developed to alleviate these drawbacks and provide further benefits to the user. These enhancements and benefits are described in greater detail herein below with respect to several alternative embodiments of the present invention.

DISCLOSURE OF THE INVENTION

The present invention in its several disclosed embodiments alleviates the drawbacks described above with respect to conventionally designed and constructed marine structures and incorporates several additionally beneficial features further enhancing the design and construction of such structures. Specifically, the present invention contemplates a novel precast, modular spar system and method of constructing same for drilling, oil and gas production, and oil storage in a variety of water depths. The spar incorporates arcuate-shaped concrete segments cast and assembled onshore to form a cylindrical module having a central longitudinal passageway. The modules are assembled onshore to form cylindrical units which are then assembled onshore or offshore to form the final cylindrical spar of the desired length and width for the specific production site. In the event the final assembly of the spar occurs onshore, the structure is towed horizontally to the production site and upended. If the final assembly of the spar occurs offshore, the modules are towed either vertically or horizontally to the production site. At the production site, the modules are vertically assembled to form the final spar structure. The spar is adapted to have a length in which its normal draft places the bottom of the spar at a location sufficiently below the water surface that the effect of waves is attenuated to very low amplitudes and wave excitation forces are relatively small. The heave motion of the spar may thereby be reduced to almost zero even in the most severe seas while surge, sway, roll and pitch motions remain within readily acceptable limits.

The invention further contemplates an equalized pressure system including a vertical column of water with a segmental length positioned concentrically along the entire length of the buoyant section of the spar and an equalized pressure pipe system for pressurizing the interior compartments of the segments to equal the pressure of the adjacent sea water. The equalized pressure pipe system is also used in the upending process and in maintaining a constant draft of the spar at the specific production site.

The present invention is intended to provide:

(a) a spar of novel precast modular construction which can be economically used from shallow to deep water applications for oil storage facilities, oil and gas production facilities, and a riser system;

(b) an independent structure which can be used with several different types of production systems;

(c) a structure which has low sensitivity to fatigue or sea water corrosion, and which is resistant to the chemical and mechanical deterioration associated with freezing and thawing;

(d) a spar buoy which provides enhanced stability in a floating catenary moored condition;

(e) a novel, inexpensive precast modular construction method for structures used from shallow to deep water applications; and (f) a novel equalized pressure system equalizing a hydrostatic pressure differential experienced at a wall of a marine structure at a predetermined operational water depth.

As an independent structure, the present invention may take the form of a spar which can be used with several different types of production systems such as tension leg platforms, semi-submersible platforms, FPSO's or to support topside production, facilities and crew living structure. As can be appreciated, the enhanced stability of a marine structure with at least one spar lends itself to supporting an oil/gas production package, hotel accommodations, launch pad, runway, heliport or other activities which require a stable payload platform. A further purpose of the invention is to provide a simple, inexpensively constructed modular marine structure, such as a spar, with an equalized pressure system capable of equalizing a hydrostatic pressure differential experienced at a wall of the marine structure at a predetermined operational water depth.

The novel precast modular construction method simplifies the required structural engineering by the repetitive use of rings or pre-cast modular units. The precast modular units are cast and erected on land to form the substantial portion or the whole marine structure. Construction of the structure with pre-tensioned and post-tensioned reinforced concrete provides an extremely large safety fatigue factor. The standard construction aids in fabrication plant productivity and quality control. Structural engineering is simplified and uniform wall thicknesses can be achieved because a novel equalizing pressure system is utilized to equalize the pressure differential across the submerged portion of the marine structure's hull or wall.

In its simplest form, the equalizing pressure system includes a pressurized gas source fluidly connected via a conduit to at least two internal compartments of a marine structure (like a spar system) designed to be located underwater for at least portions of the structure's operation life. The compartments are fluidly connected to each other to allow gas and water to flow between the compartments and the water column, which substantially surrounds the marine structure.

As may be appreciated, if an interior compartment of a marine structure is open at its bottom to the surrounding water column, the pressure differential across the marine structure's hull plating adjacent to the interior compartment will be equal to, or nearly zero regardless of the depth at which the compartment is located. Furthermore, by positioning a fluid passage at a lower portion of the compartment, gas can be pumped through the passage and into the compartment to be trapped in an upper portion thereof. As the gas pressure increases in the fluid passage, water exits through the bottom opening of the compartment. If the gas pressure in the fluid passage decreases, water moves into the compartment through the bottom opening, and any gas in the compartment is compressed to a pressure substantially equal to the hydrostatic pressure at the bottom opening. In this manner, the pressure within the compartment is substantially equal to the hydrostatic pressure at the bottom opening. If the marine structure has a significant height, there will be a pressure differential gradient experienced along the height of the hull plating or wall since the interior pressure will be uniformly equal to the hydrostatic pressure at the bottom opening while the hydrostatic pressure on the outside of the marine structure will vary with respect to depth. Normally, a particular marine structure will have a height sufficiently short where this gradient presents little effect. If, however, the marine structure is significantly tall, it may be easily segmented into a plurality of one-above-the-other compartments, each having an individualized equalizing capability. By controlling the balance between the volume of water and gas in the compartment, the buoyant effects experienced upon the marine structure can be altered.

In another aspect, the equalizing pressure system of the present invention further includes a pressurized gas source fluidly connected via a conduit system to two or more compartments of a marine structure situated in water. Each compartment has a passage configured to allow gas and/or water to freely pass between the lower region of a compartment and the water, which surrounds the marine structure. The conduit system has a manifold positioned between the gas source and a plurality of pipes, each of which connects to the two or more compartments. The conduit system permits selective and variable control of the buoyancy factor obtainable from the vessel.

In a further embodiment, the gas source is fluidly connected via a segmented conduit system to two or more compartments of a marine structure situated in water. The segmented conduit system is configured to allow gas and/or water to flow between adjacent compartments and the body of water in which the marine structure is situated.

While the invention is described as an equalizing pressure system for marine structures, it is clearly possible to apply the same system and methods to other structures, fluids and/or materials where pressure equalization is desired between interior and exterior spaces of a vessel; and it is permissible that at least a limited amount of exterior surrounding fluid, whether it be liquid or gas, migrate between the two spaces.

The beneficial effects described above apply generally to the exemplary devices and mechanisms disclosed herein for an equalizing pressure vessel typified as an underwater buoyancy vessel. The specific structures through which these benefits are delivered will be described in detail herein below.

BRIEF DESCRIPTION OF THE DRAWINGS

The invention will now be described in greater detail in the following way of example only and with reference to the attached drawings, in which:

FIG. 3(*b*) is an elevational view of the spar with a payload platform deck, strakes, mooring lines, and mooring line storage reels.

FIG. 4(*b*) is a vertical sectional view of the truss spar with the truss and spar separated.

MODE(S) FOR CARRYING OUT THE INVENTION

Figure 1:
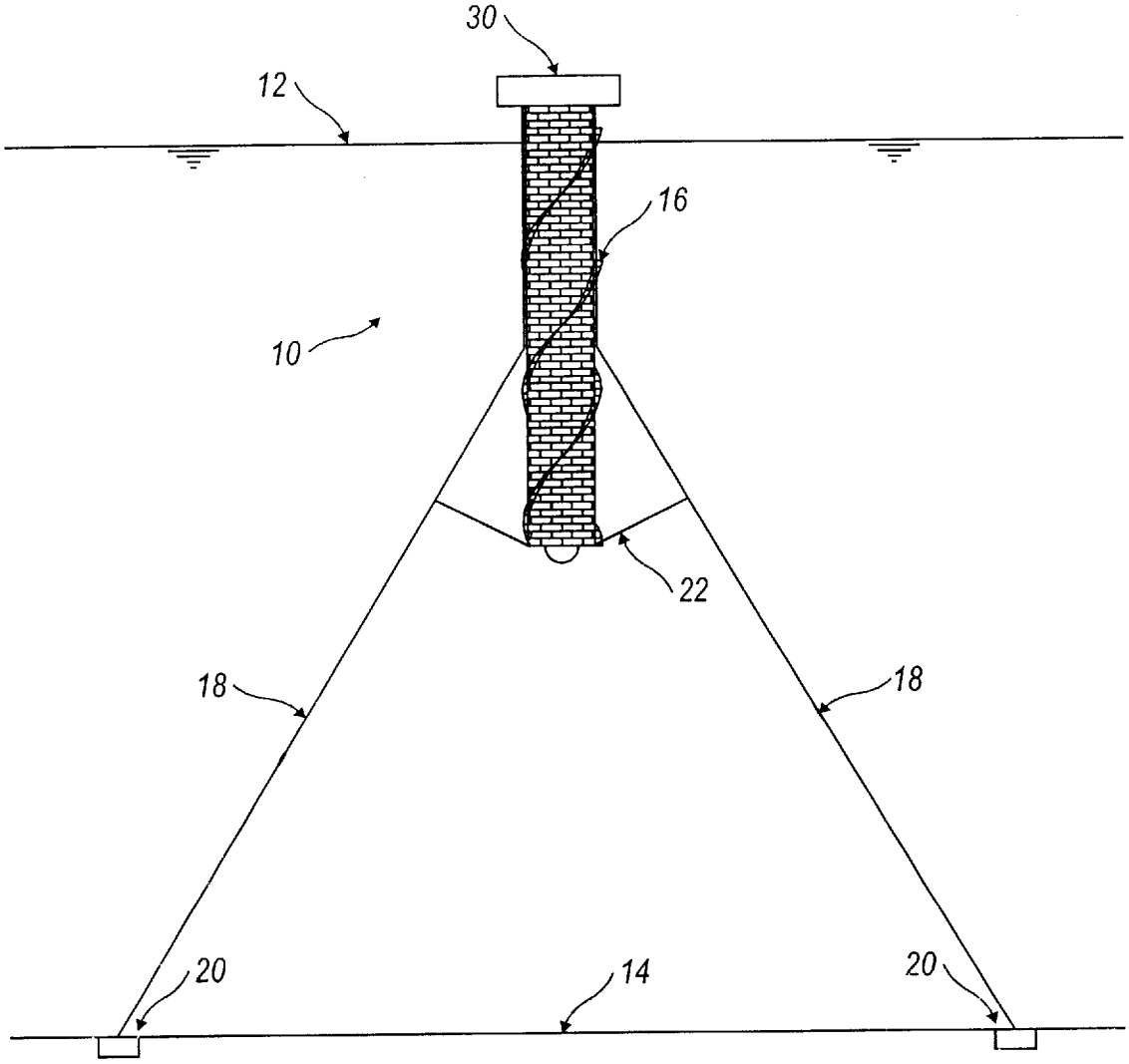
FIG. 1 is an elevational view of a spar system platform constructed in accordance with this invention.
Figure 2:
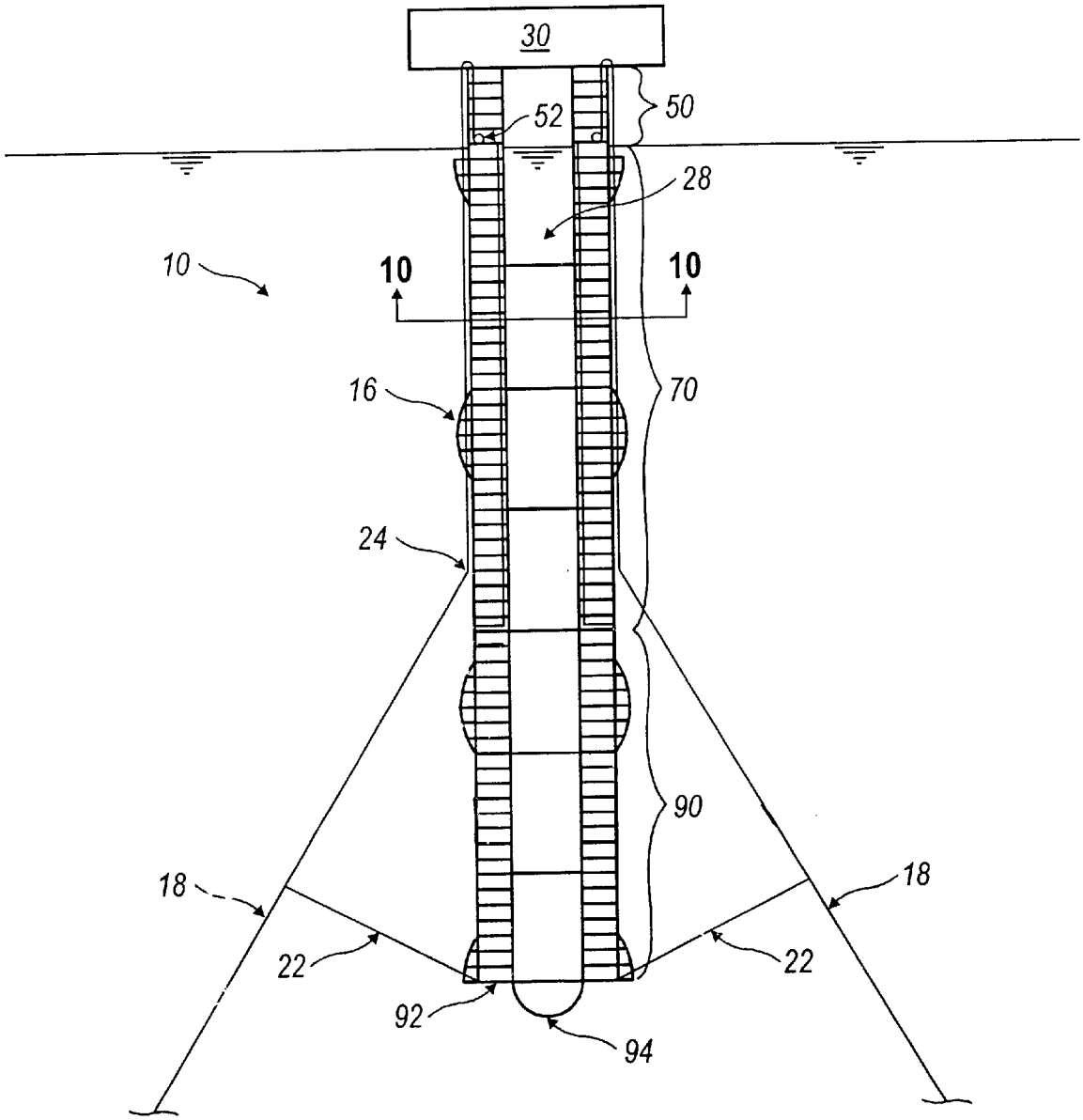
FIG. 2 is a vertical sectional view of the spar illustrated in FIG. 1.
Figures 3A, 3B:
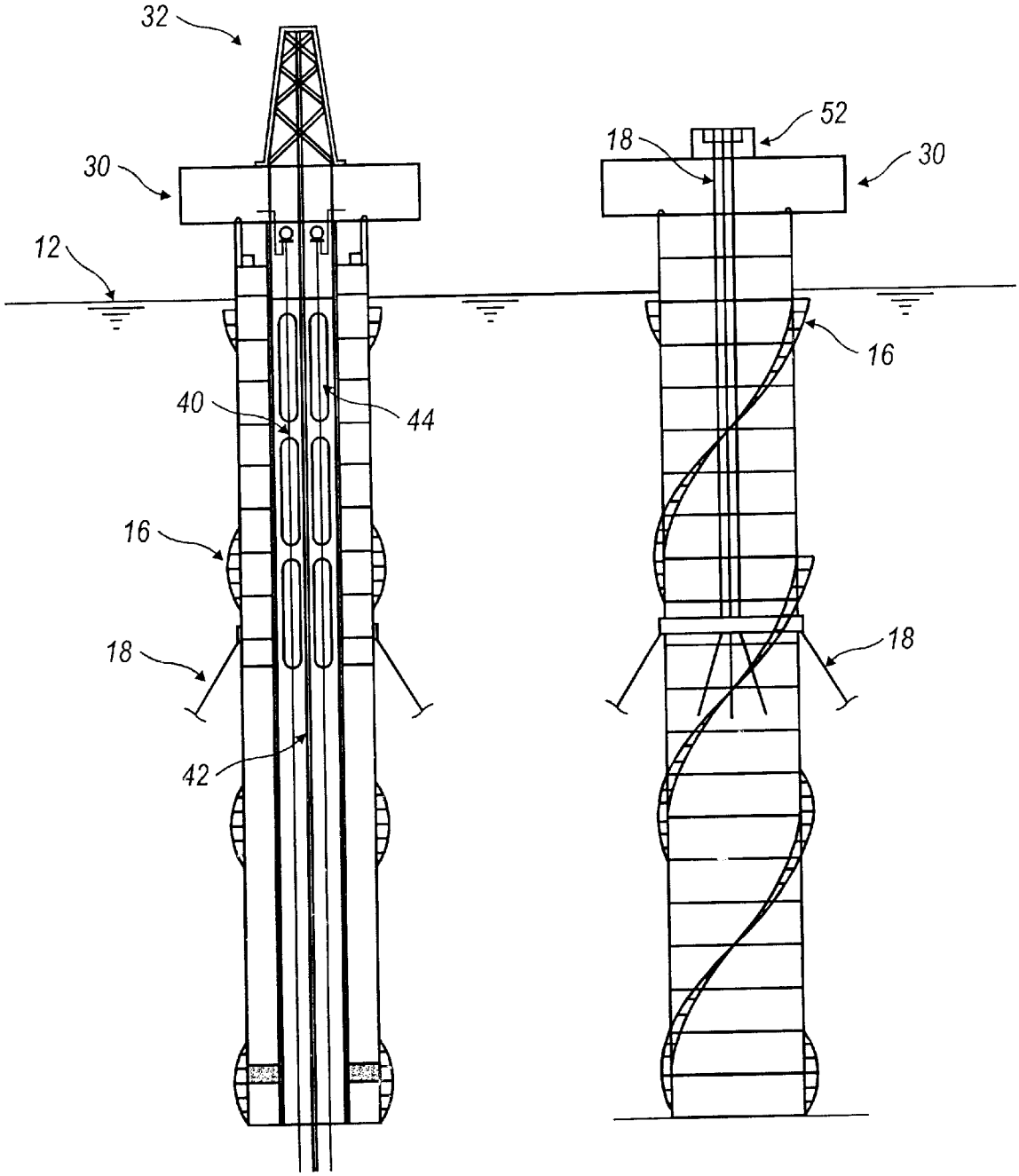
FIG. 3(*a*) is a vertical sectional view of the spar with a production platform and riser system.

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a basis for the claims and as a representative basis for teaching one skilled in the art to variously employ the present invention.

Referring to the drawings in general but FIGS. 1 through 5 in particular, a variety of precast, modular marine structures 10 embodying this invention are shown. The marine structure 10 may be located over a subsea installation on the sea floor and may be connected thereto by a riser system 40. The marine structure 10 is generally an elongated cylindrical structure having a freeboard section 50, a buoyancy section 70 substantially submerged in the water, and a ballast section 90 attached beneath the buoyancy section 70. The freeboard section 50 supports a payload platform 30 at a selected height above the water surface 12 to provide suitable clearance of the platform deck structure 32 above expected waves. The platform deck structure 32 is adapted to support production and associated facilities and equipment. The modular marine structure 10 includes an axial longitudinal passageway 28 which extends from the top of the modular marine structure 10 to a keel 92. The keel 92 has a draft below any significant expected wave action at the production site. Ports on the freeboard section 50 release pressure from breaking waves (not shown). Strakes 16, being located on the outer part of the modular marine structure 10, have horizontal surfaces which enhances vortex shedding. From the bottom portion of the modular marine structure 10, a plurality of riser pipes 42 forming a riser system 40 may extend to a sea floor template (not shown). The modular marine structure 10 is anchored by a plurality of taut mooring lines 18 secured at one of their ends to a sea floor 14 by anchors 20 embedded in the sea floor 14 and secured at their other end to the modular marine structure 10 at a selected point 24 near the center of rotation. In a preferred embodiment, each of the mooring lines 18 bends over a fairlead (not shown) and extends up the marine structure 10 and connects to mooring windlasses 52 located at, below or above the freeboard section 50. Unique mooring tethers 22 connect the keel 92 or lower end of the marine structure 10 to the mooring lines 18, one for each mooring line 18. In a preferred embodiment, each of the tethers 22 bends over a fairlead (not shown) and extends up the marine structure 10 and connects to tether windlasses (not shown). The tethers 22 provide additional stability during strong wind and current loading and further reduce tilt of the marine structure 10 by transferring loads to opposing mooring lines 18. In combination or separately, the mooring lines 18 and tethers 22 can be adjusted to move the marine structure in a predetermined manner.

In the form of a truss spar (FIG. 4), the marine structure 10 includes a freeboard section (not shown), a buoyancy section 70 and a ballast truss section 91. The freeboard section and buoyancy section 70 include components as described above. The ballast truss section 91 includes at least one riser tube 402 connected to a truss 400 and at least one flat 401. The ballast truss section 91 is connected to at least the buoyancy section 70 by at least one riser tube 402. At least one riser tube 402 extends through at least a significant portion of the buoyancy section 70 and attaches to a corresponding truss support beam 403. The riser tube 402 is pre-tensioned so that the ballast truss section 91 is in compression with the buoyancy section 70. The truss support beams 403 transfer compressive forces into the buoyancy section 70. Lateral movement between the buoyancy section 70 and the ballast truss section 91 is eliminated or at least significantly reduced by alignment pins 404 positioned between the two sections.

In one embodiment, at least one riser tube 402 passes through the moon pool 24 and attaches to the truss support beam 403 located at the top of the buoyancy section 70. In another embodiment, at least one riser tubes 402 extends through a longitudinal passageway 28. In yet another embodiment, at least one riser tube 402 is open about its length and adapted to accommodate production riser systems 40 and buoyancy cans 44. Still further, in another embodiment, at least one riser tube 402 includes an equalized pressure system 170.

Figure 5:
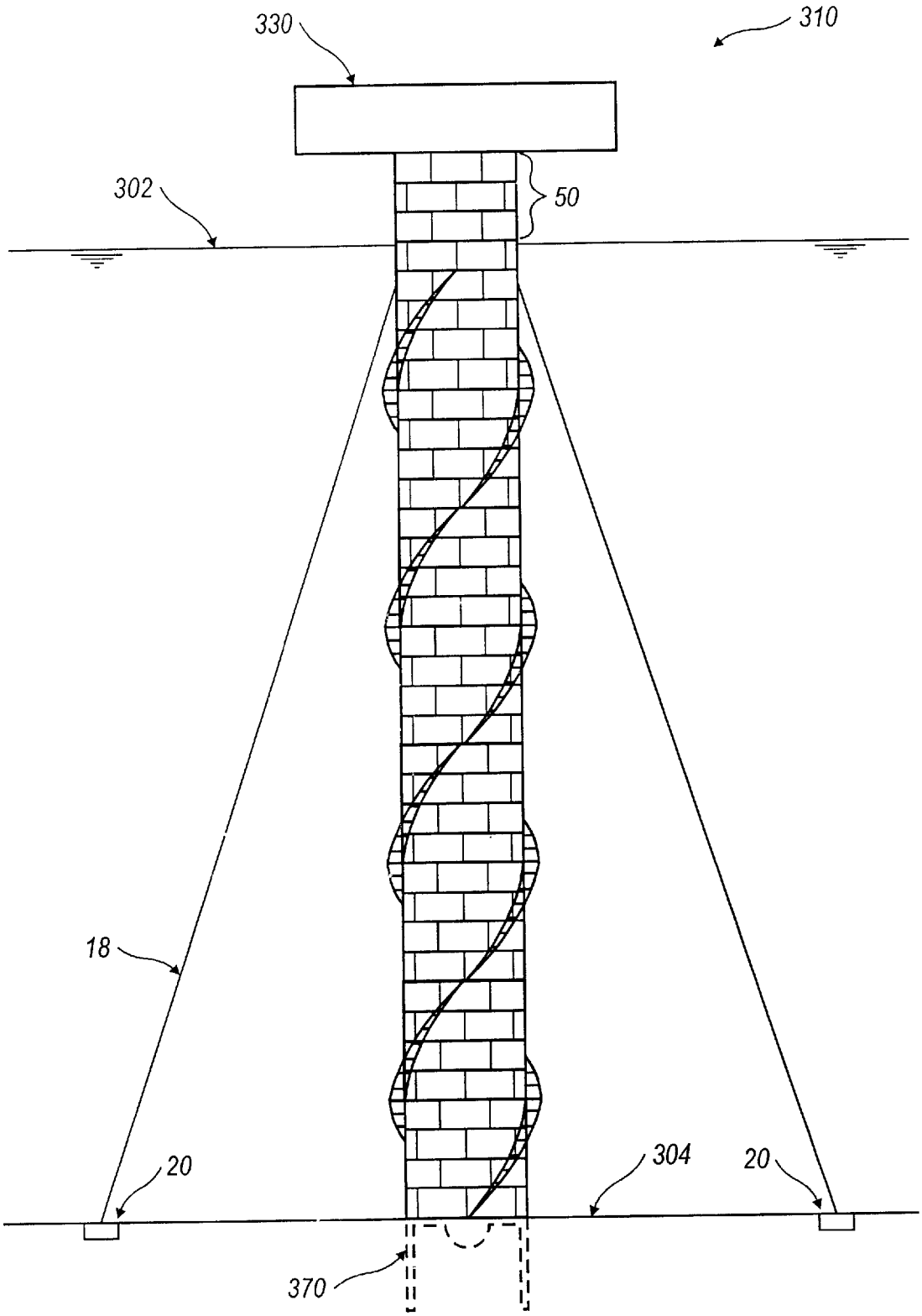
FIG. 5 is an elevational view of an alternate embodiment of the present invention.
Figure 6:
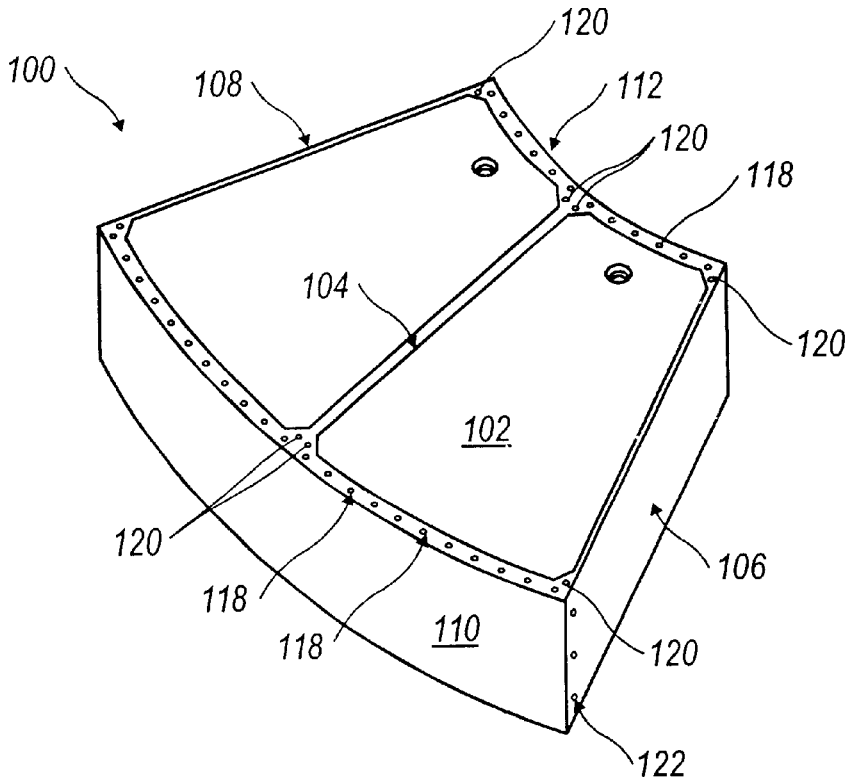
FIG. 6 is a top isometric view of a segment for the buoyancy section of the present invention.
Figure 7:
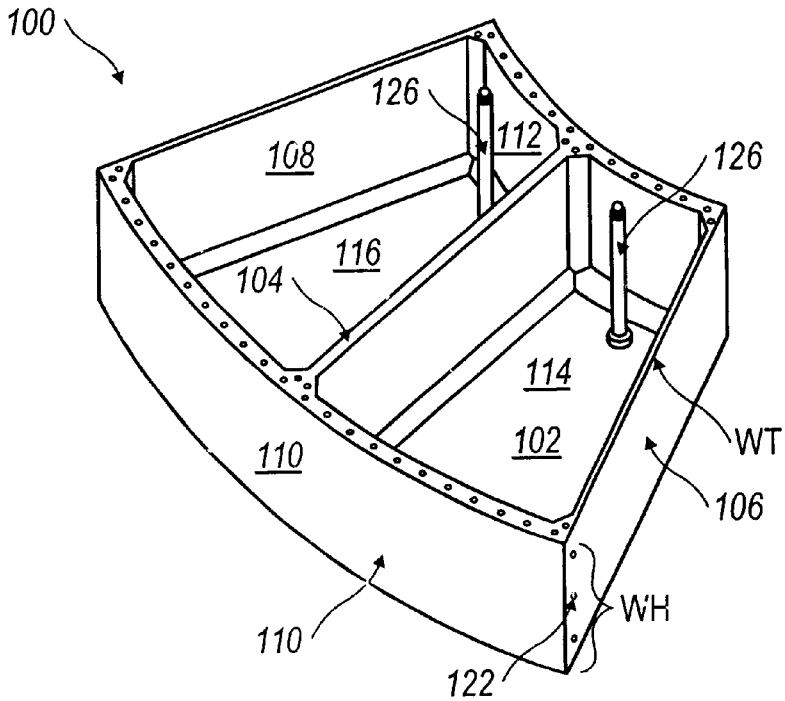
FIG. 7 is a bottom isometric view of the segment for the buoyancy section of the present invention.
Figure 8:
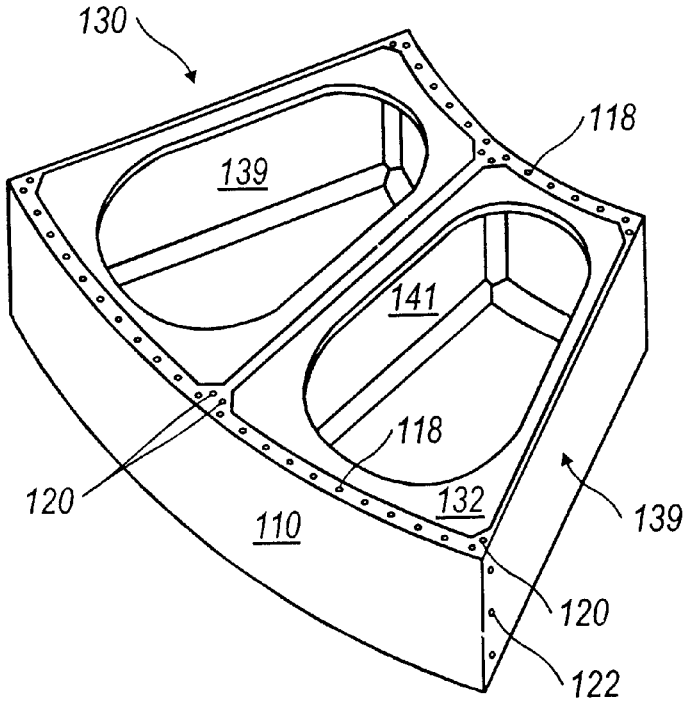
FIG. 8 is a top isometric view of the segment for the ballast section of the present invention.
Figure 9:
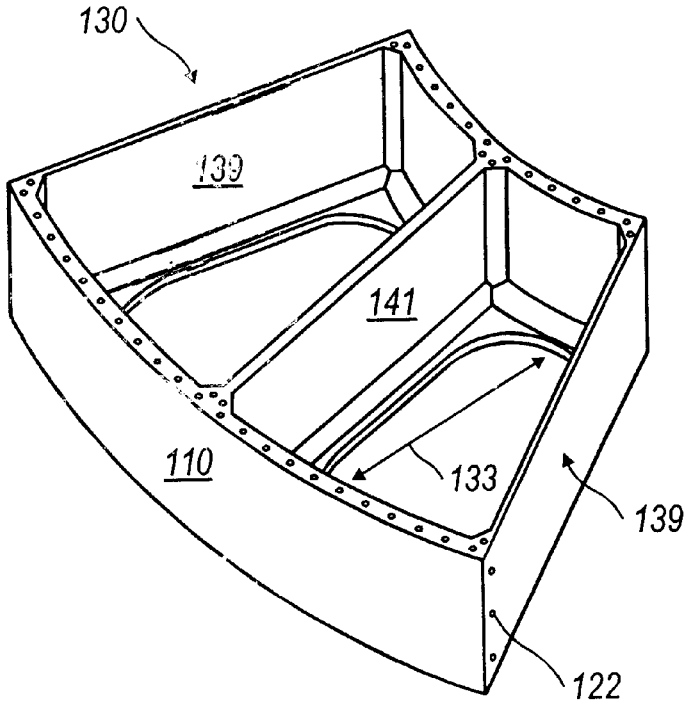
FIG. 9 is a bottom isometric view of the segment for the ballast section of the present invention.
Figure 10:
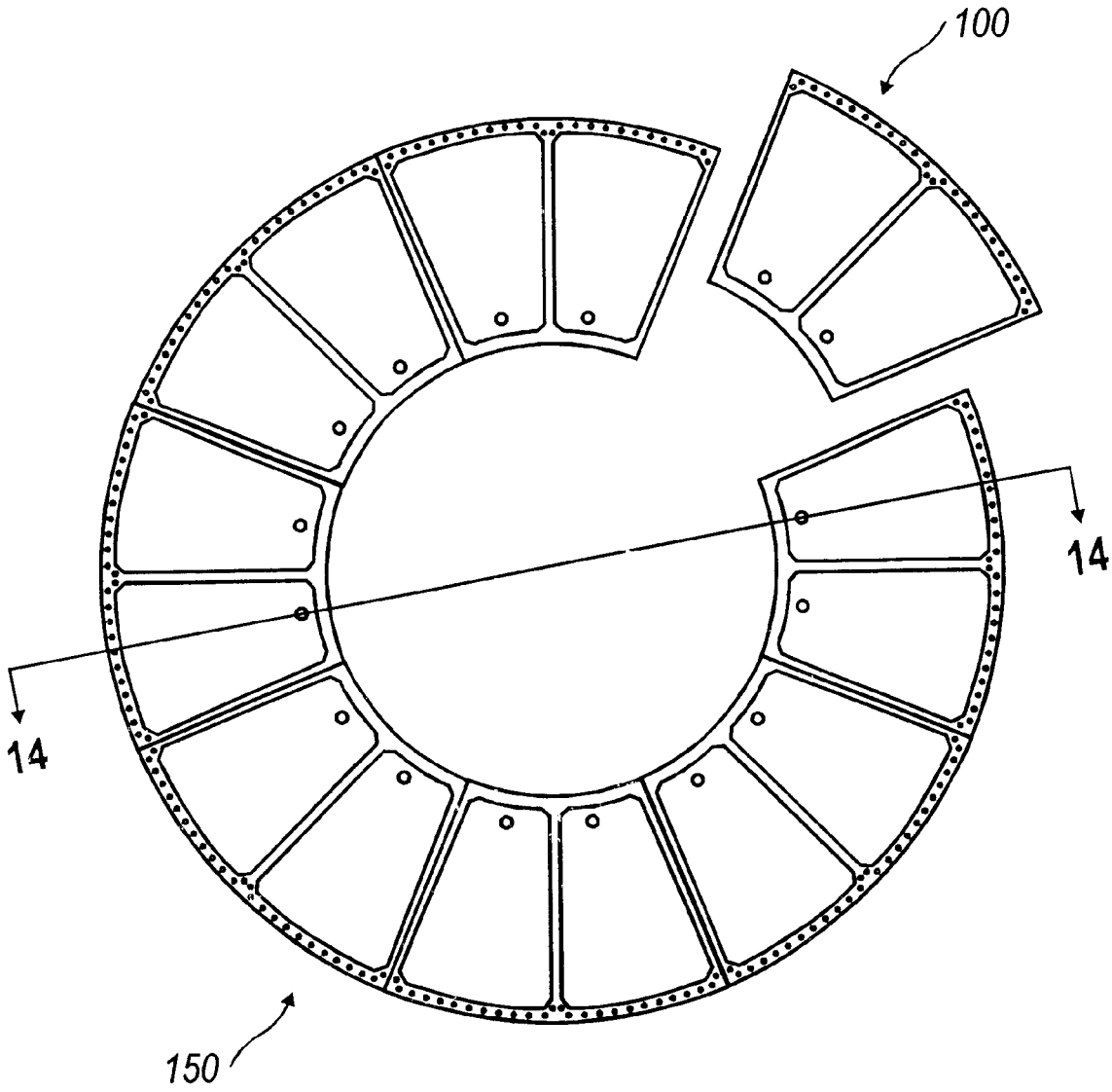
FIG. 10 is a cross sectional view of a buoyancy module indicated by the sectional view referenced in FIG. 2.

In the form of a tension shaft system as shown in FIG. 5, the marine structure 10 is a cylindrical spar 310 which includes a freeboard section 50, a buoyancy section 70, a ballast section 90 and a skirt foundation 370. The freeboard section 50, buoyancy section 70 and ballast section 90 include the components disclosed above. The skirt foundation 370 is adapted to penetrate the seabed 304 when sufficient ballast is added to the cylindrical spar 310 and thereafter anchor one end of the cylindrical spar 310 to the seabed 304. In another embodiment, the skirt foundation 370 is configured with a fluid pressure system (not shown) to remove the upper layers of the seabed 304 from inside the skirt foundation 370. The fluid pressure system or a separate injection system (not shown) is utilized to pump concrete or other dense fluids (such as brine, calcium chloride, or mud) into the skirt foundation 370. As can be appreciated, the skirt foundation 370 may include an equalized pressure system 170. This equalized pressure system 170 could further be used to convey the concrete or other dense material into the skirt foundation 370.

Turning to FIGS. 6, 7, 8, 9 and 10, it may be seen that segment 208 is the smallest building block of a modular marine structure 10 constructed in accordance with the present invention. The segment 208 is a unitized product that can be mass produced in varying shapes to construct the desired structure. The segment 208 may be joined to form circular modules that make a donut-like object; a rectangular or square box that make a barge-like object; or other shapes adapted for specific applications.

The segment 208 is manufactured from reinforced concrete materials that are cast in molds or forms 204 (FIGS. 19 and 20) to produce uniform products. The segment 208 has perimeter and interior walls with sufficient thickness for structural strength and for housing conduits 120 for passage of pre- and post-tensioning tendons 121 (FIG. 14) that couple several segments 208 to form larger modules 150, that form units 160, and ultimately form the final modular marine structure 10 being constructed.

Figure 11:
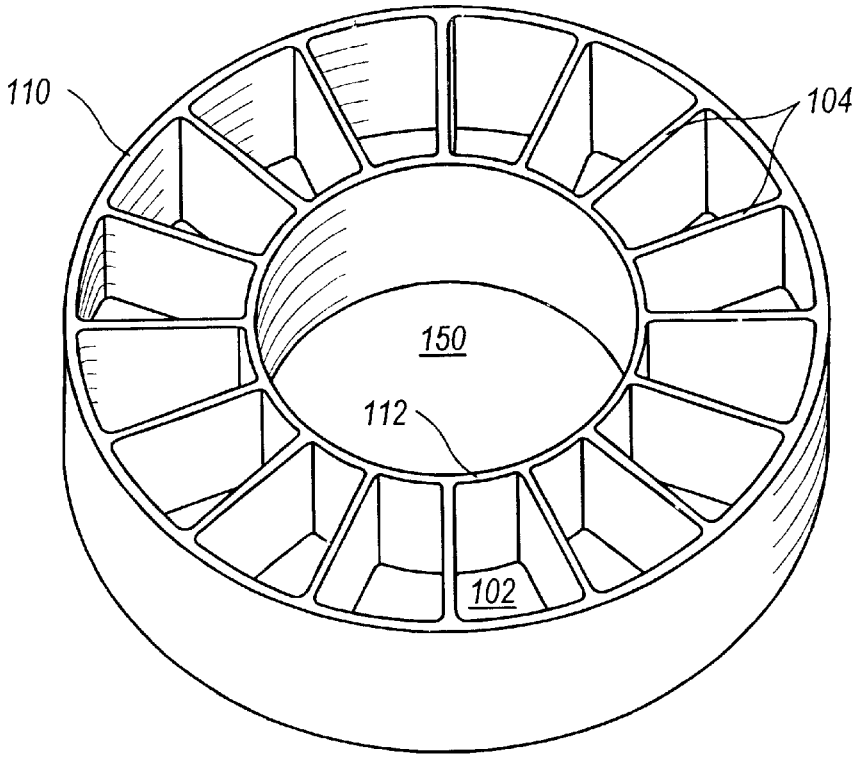
FIG. 11 is a bottom view of the buoyancy module.
Figure 12:
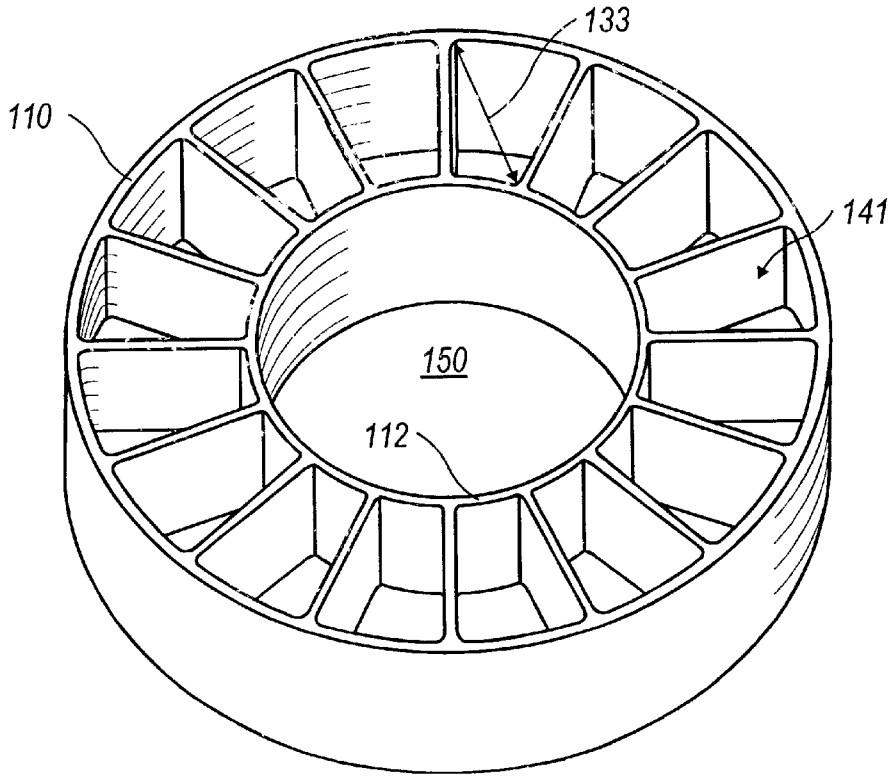
FIG. 12 is a an isometric view of a ballast module.
Figure 13A:
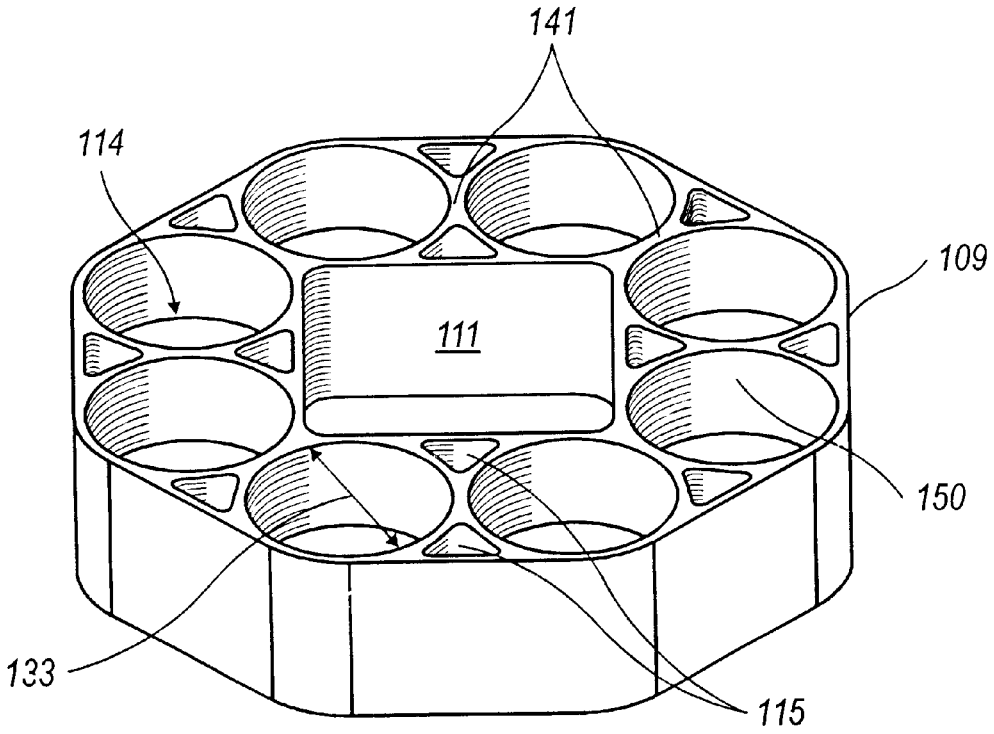
FIGS. 13(*a*) bottom and (*b*) top are views of an octagonal module.
Figure 13B:
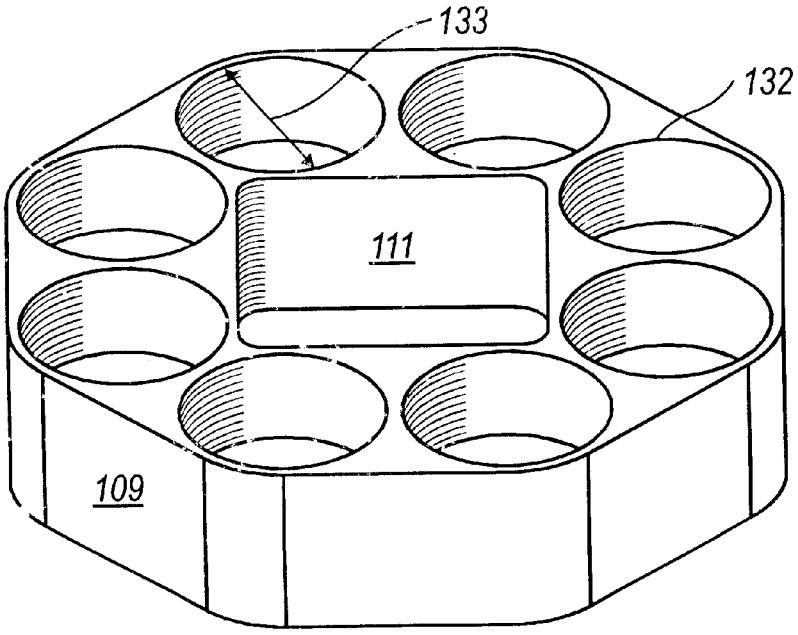

In an alternative embodiment, the smallest building block is the module 150 as shown in FIGS. 11, 12, 13(*a*) and 13(*b*). Like the segment 208, the module 150 is a unitized product mass produced from reinforced concrete materials that are cast in molds or forms 204. The forms 204 can be configured to produce modules in varying shapes to construct the desired structure.

Whether built from segments 208 or modules 150, the modular marine structure 10 generally includes an outer portion and an axial longitudinal passageway 28. The outer portion incorporates a freeboard section 50, a buoyancy section 70 and a ballast section 90. In a preferred embodiment, the outer portion includes a plurality of strakes 16 having surfaces engagingly positioned thereon. Specifically, the ballast section 90 is operatively coupled to, preferably underneath, the buoyancy section 70. The freeboard section 50 is adapted to support a payload platform 30 suitable to accommodate an oil/gas production package, hotel accommodations, launch pad, runway, heliport or other packages. In a preferred embodiment, the freeboard section 50 may include at least one port (not shown) securingly mounted thereon in order to relieve pressure that has built upon the marine structure 10.

Each module 150 positioned in the buoyancy or ballast section includes a top slab 102, 132, at least two tangential walls 104, 106, 139, 141, at least two radial walls 110, 112, and at least two cells 114, 116. The buoyancy section 70 may include a plurality of keyways 124 mounted on the buoyancy section 70 to facilitate stacking. Specifically, the inner radial wall 112 and the outer radial wall 110 are connected by the tangential walls 104, 106, 139, 141 to form at least two cells 114, 116. The top slab 102, 132, respectively, connectively extends across the walls, namely the outer radial wall 110, the inner radial wall 112 and the tangential walls 104, 106, 139, 141. However, unlike the buoyancy segment 100, the ballast segment 130 further includes a passageway 133 receivingly disposed through the top slab 132. Further, trim valves 128 may be inserted through the top slab 132 allowing water to enter the ballast segments 130 of the ballast section 90 in a moderately controlled manner.

In an alternative embodiment, the tangential walls 104, 106, 139, 141 include furcated end portions, which connect to the radial walls 110 and 112. In a further embodiment, the inner and outer radial walls 110 and 112 and/or the tangential walls 104, 106, 139 and 141 can be arranged to form a module 150 with arcuate shapes. For example, in FIGS. 13(*a*) and (*b*), a module 150 for use in the ballast section 90 includes eight tangential walls 141 with furcated end portions connecting a rectangular inner radial wall 112 to an outer radial wall 110 of a generally octagonal shape to form eight arcuate shaped cells 114 and 12 voids 115.

Figure 4A:
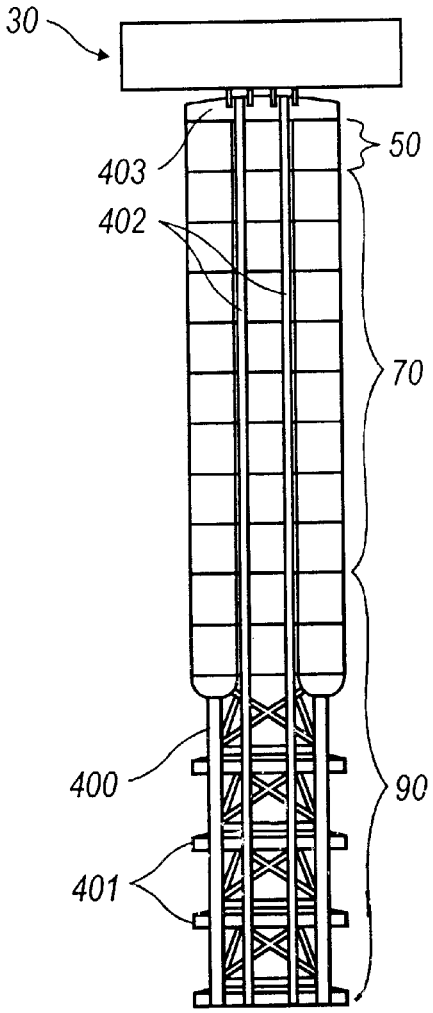
FIG. 4(*a*) is a vertical sectional view of a truss spar.
Figure 4B:
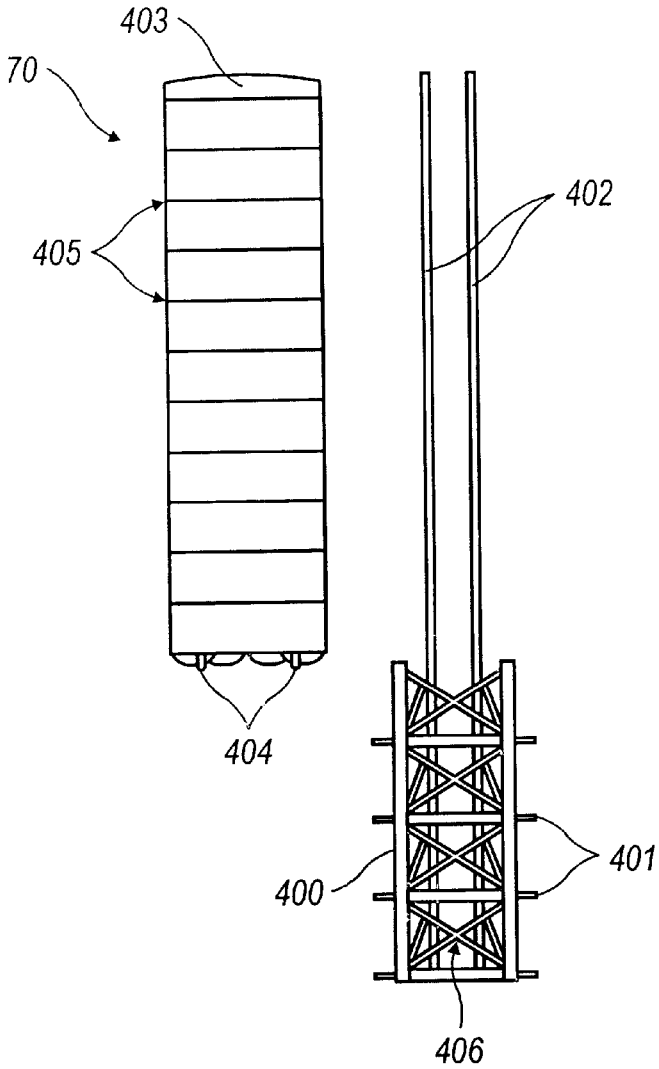

An alternative embodiment of the present invention is shown in FIG. 4. In this embodiment, the marine structure 10 takes the form of a truss spar which includes a buoyancy section 70 and ballast truss section 91 in compression against each other. The compression is generated by passing at least one pre-tensioned riser tube 402 across the zone between the buoyancy section 70 and the ballast truss section 91. The riser tube(s) 402 can be open about their length and designed to accommodate production risers, umbilicals, buoyancy cans and/or control systems for the marine structure 10.

One embodiment contemplates at least one pre-tensioned riser tube 402 with two ends passing through at least one module 150 with the first end connected to a truss support beam 403 and the second end connected to a truss 400. The truss support beam 403 is capable of transferring compressive forces generated by the truss 400, in an operational condition, into the buoyancy section 70. In a preferred embodiment, the truss support beam 403 is positioned near the top of the buoyancy section 70 thereby subjecting the modules through which the riser tube 402 passes to compression loading. At a minimum, the compression loading minimizes leaks at the module joints 405 in the buoyancy section 70.

The truss 400 may take a number of shapes and forms to enhance the stability, rigidity and/or motion characteristics of the marine structure 10. In one embodiment, the truss 400 includes a lattice of interconnected members 406 and flats 401 attached to a portion of the riser tube(s) 402. Lateral movement between the truss 400 and the module 150 adjacent to the truss 400 is precluded by alignment pins 404 permanently fixed to the module 150.

The Equalized Pressure System

The equalized pressure system includes at least one cell within the cylindrical or tubular structure fluidly connected to a fluid source 78 and further fluidly connected by a fluid conduit to water adjacently surrounding the marine structure 10. The fluid source 78 can be a pressurized gas source configured to provide an adequate supply of an air mixture, noble gas, inert gas, scrubbed and cleaned exhaust gas mixture or any other readily available gas to completely void the cell or each cell 116 of water through the fluid conduit.

In one embodiment, for each cell 116, the fluid conduit passes through a radial wall 110 and/or 112 in the lower region of the cell 116 thereby allowing fluid communication between a cell 116 and the adjacent water. In another embodiment, the fluid conduit has an opening near one of its ends which can be adjusted accordingly within a cell 116 in order to position the opening at any height within the cell 116 thereby controlling the buoyant force of a cell 116. The adjustment of the fluid conduit is structurally achieved by either slidably fixing the fluid conduit to a cell 116 or constructing the fluid conduit in a telescopic configuration similar to that of well bore casing. The fluid conduit can be positioned in the marine structure 10 or on the exterior or interior surface of the marine structure 10, a cell 116 and/or a wall.

Preferably, the cell or each cell 116 extends through a portion of the buoyancy section 70. In another embodiment, each cell 114 or 116 substantially or partially wraps around the axial longitudinal passageway 28 such as the interior space of the cylindrical or tubular structure (like a riser conduit or tension leg) which extends substantially uninterrupted from a top portion to a bottom portion of the marine structure 10. As can be appreciated, the cross sectional shape of the marine structure 10 and/or the cell 116 may be configured in a circular, elliptical, polygonal or a combination of shapes thereof depending upon strength factors and construction considerations.

Figure 15A:
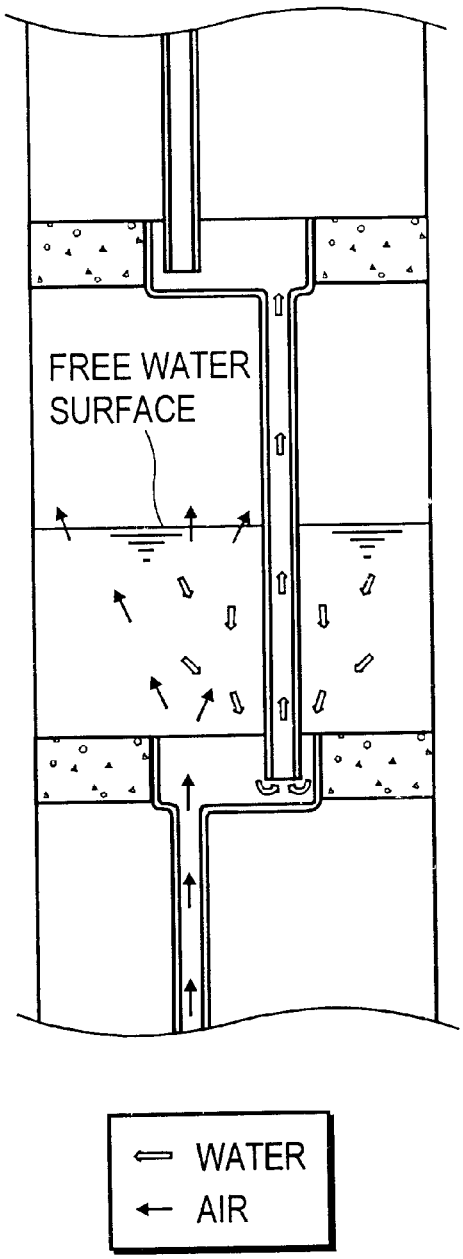
FIGS. 15(*a*) and (*b*) are enlarged sectional views of an equalized pressure system during evacuation and operational conditions.
Figure 15B:
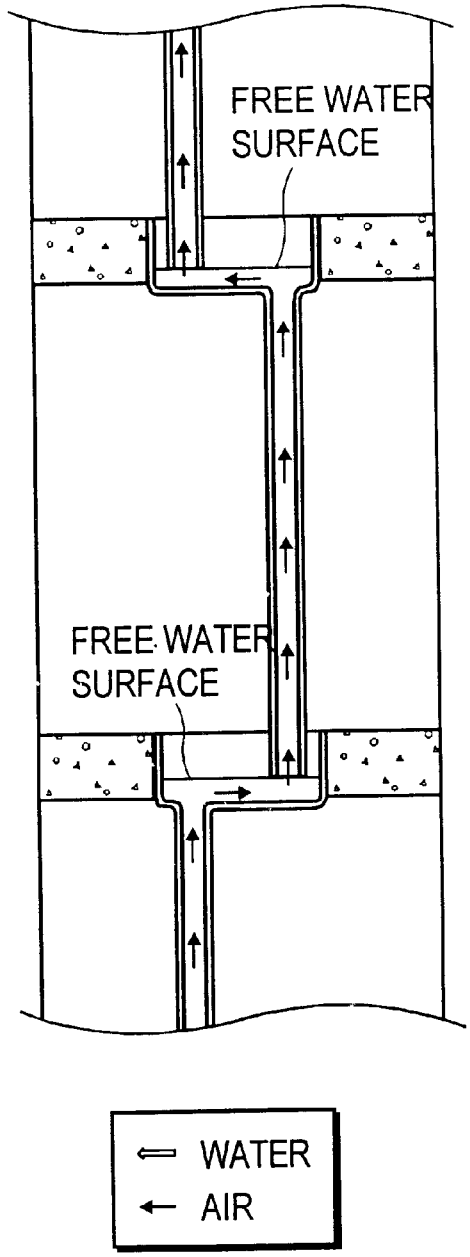
Figure 16:
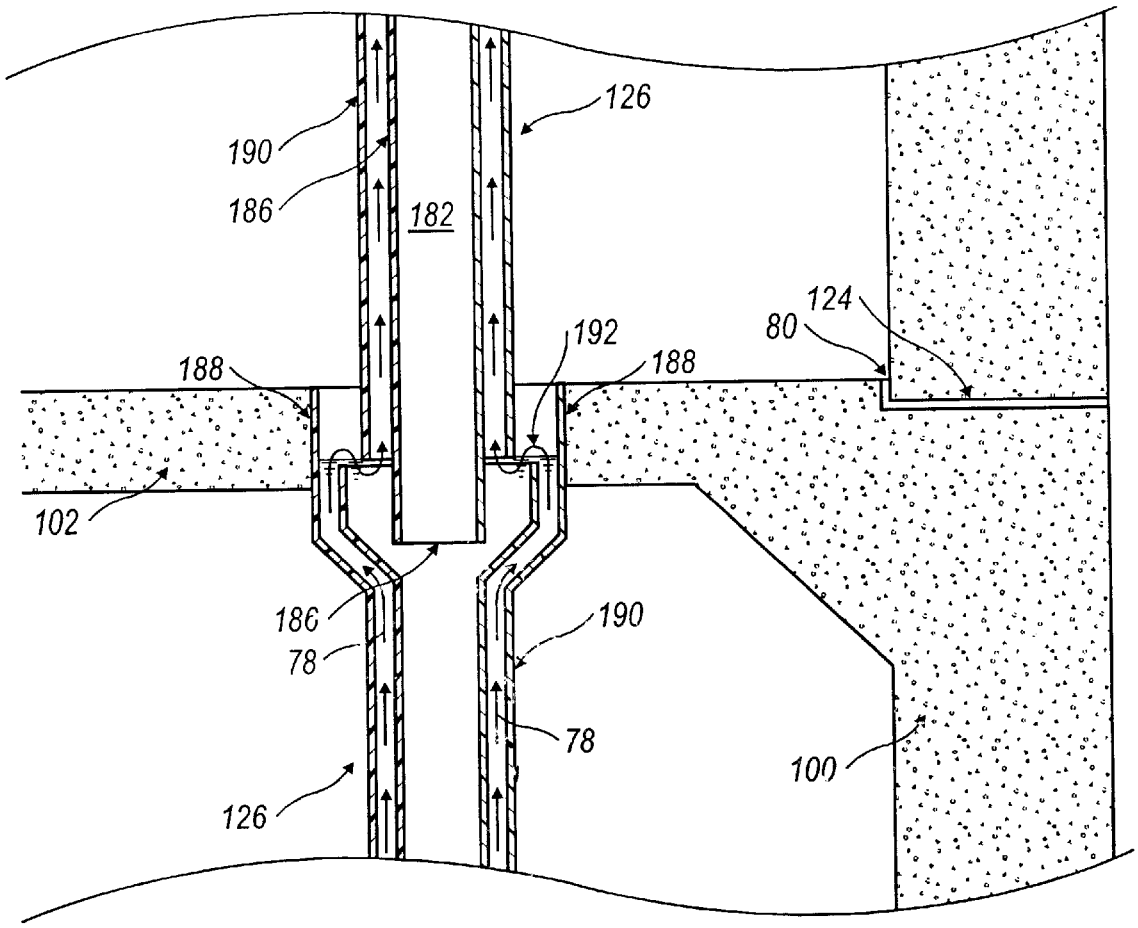
FIG. 16 is an enlarged sectional view of air flow during operational condition indicated by reference in FIG. 14.
Figure 17:
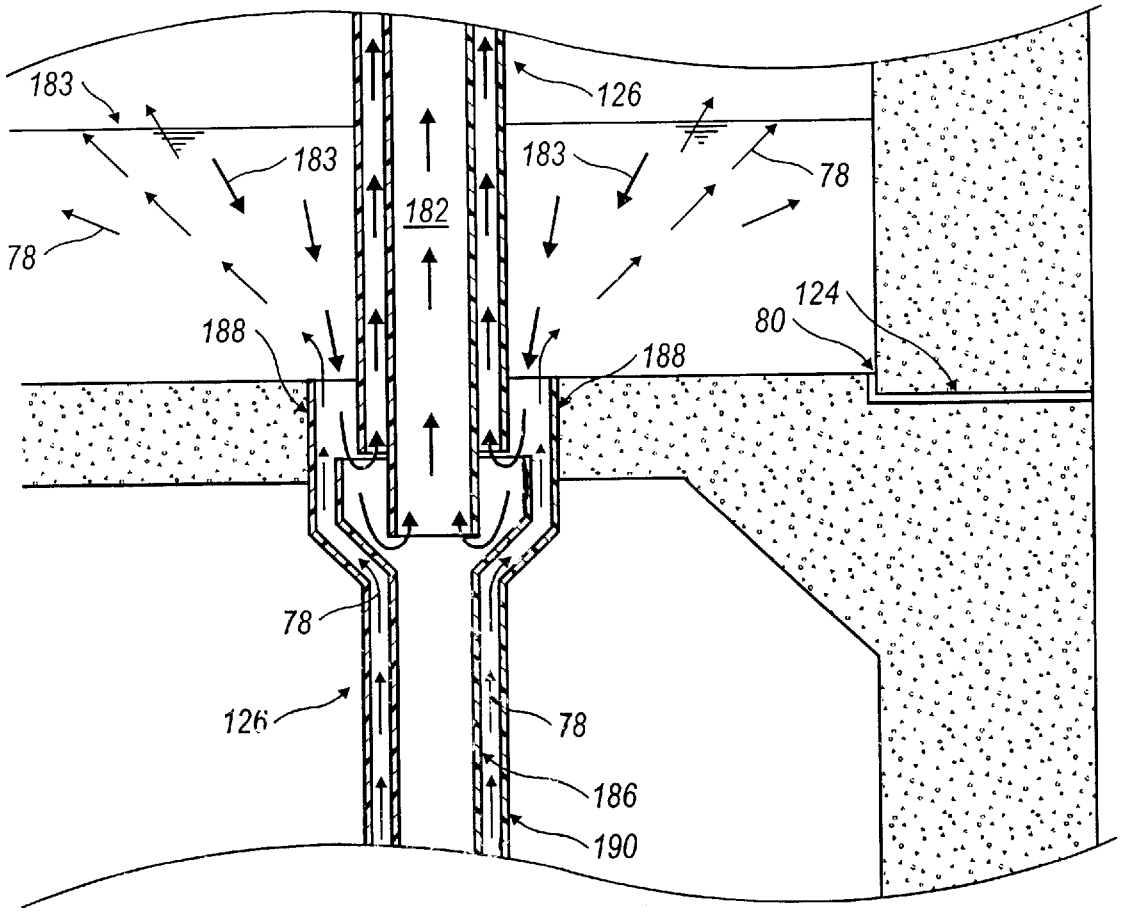
FIG. 17 is an enlarged sectional view of air and water flow during setup operation indicated by reference in FIG. 14.

FIGS. 14–18 show an equalized pressure system for the marine structure 10 including a segmented vertical column of water that fluidly connects at least two cells 116 to each other and the water surrounding the structure 10. A pressurized gas source 78 is fluidly connected by a gas inlet to at least one of the cells 116. The segmented vertical column of water 182 is achieved by positioning a sufficient number of pressure conduits 172 within the marine structure 10 so that an opening of a pressure conduit is located at a lower region of a cell 116 and a discharge of a pressure conduit is located at a lower region of another cell 116. In another embodiment, the fluid conduit is a double-walled pipe 126 (FIGS. 16 and 17). The pressurized gas source is configured to provide an adequate supply of an air mixture, noble gas, inert gas, scrubbed and cleaned exhaust gas mixture or any other readily available gas to completely void the cells 116 of any water down to the level of the discharge 173.

The method of equalizing the pressure and altering the buoyancy of a structure 10 starts with a significant number of cells 116 substantially filled with water. A gas, such as air, from a pressurized gas source is introduced into the cell 116 via a gas inlet 74. As depicted in FIG. 15*a*, the compressed gas begins to accumulate at the upper region of a cell 116, forcing water to flow from a submerged opening 174 through fluidly connected cells 116 to a discharge 173 positioned in the water adjacent to the structure 10. As the free water surface 192 in a cell 116 approaches the depth of an opening 174, gas begins to flow into the same opening 174 and exits a corresponding discharge 173 positioned in a different cell 116. As can be appreciated, once the water level drops to or near an opening 174, mostly gas will flow to the next cell 116 to again accumulate at the upper region of a cell 116 and force water to flow through the next submerged opening 174. The above-described steps are repeated until the requisite number of cells 116 are voided.

Figure 14:
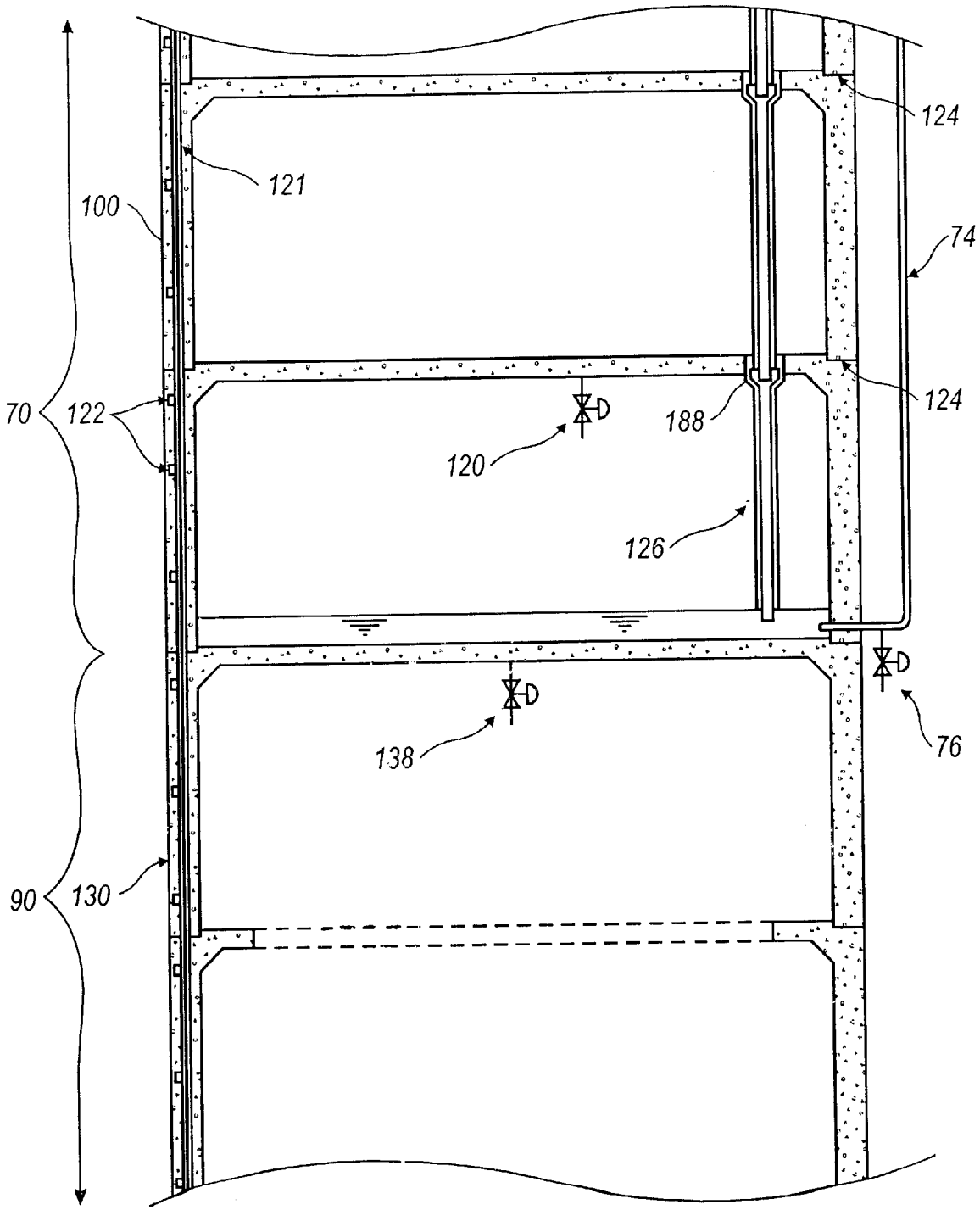
FIG. 14 is an enlarged sectional view of an equalized pressure system and trim system of the present invention.
Figure 18:
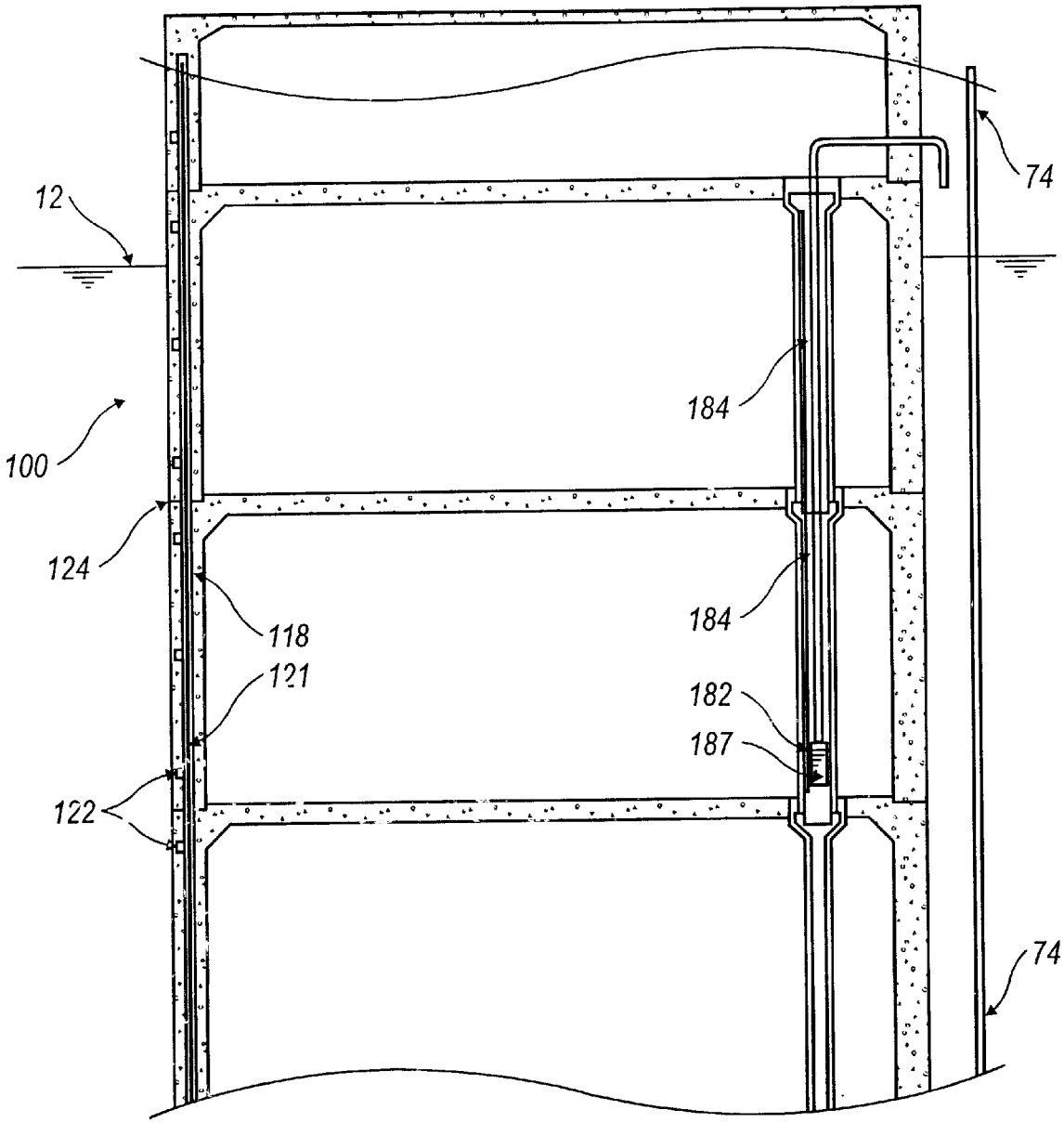
FIG. 18 is an enlarged sectional view of the equalized pressure system control tank.

In another embodiment, the equalized pressure system 170 includes a plurality of double-walled equalized pressure pipes 126 extending through the segments 100 forming the buoyancy section 70, a segmented vertical column of water 182 residing in the double-walled pipes 126, buoyancy cells 114, 116, control tanks 184, remote controlled trim valves 128, and a water pump 187 (FIG. 18). The equalized pressure system 170 allows the pressure within any cell 114, 116 at any depth to be approximately equal to the external water pressure at the same depth. The inner equalized pressure pipe 186 of the double-walled pipes 126 is adapted to carry water 183. As shown in FIG. 14, a pipe hub 188 embedded within the top slab 102 allows the inner pipe 186, descending from the above segment, to be inserted a sufficient distance (d) below the free water surface 192 to ensure air 78 will not enter the inner pipe 186 even during large pitch and roll motions of the marine structure 10. By preventing air 78 from entering the inner pipe 186 the water of the water column 182 is not affected. If air were permitted to displace the water in the water column 182, the head pressure of the water column 182 would be lowered causing an unequal or differential pressure between the water pressure outside and the air pressure inside the segment 208. Water resistant adhesive type material 80 coating the keyway 124 of a segment 208 provides a secure and substantially airtight sealer between the cells 114, 116 of stacked buoyancy segments 100.

As shown in FIG. 17, the inner pipe 186 is also used to evacuate water 183 being displaced from the segments 100 of the buoyancy section 70 during the upending of the marine structure 10 from the horizontal towed position to the vertical operational position. High pressure air 78 is pumped into the buoyancy segments 100 filling the cells with air 78 and displacing the water 183. This displaced water 183 is forced into and up through the double-walled pipe 126 and ultimately into the control tanks 184 (illustrated as top segments of the pipe 126 in FIG. 18), causing the water level within the control tanks 184 to rise. The excess water in the tank 184 is then discharged into the moon pool 26 by water pumps 187 located within the control tanks 184.

Turning to FIGS. 16 and 17, the outer equalized pressure pipe 190 of the double-walled pipe performs in a similar manner as the inner pipe 186. The outer pipe 190 creates an annulus between the inner and outer pipes 186 and 190, respectively. During the upending process, the annulus carries both air and water. When pressurized air 78 is pumped into the cells and begins to displace water 183, the displaced water 183 is discharged upward through the ascending inner pipe 186 and outer pipe 190 while the annulus below is carrying the rising pressurized air 78. When the displaced water level 192 reaches the bottom of the outer pipe 190, the pressurized air 78 will then rise into the annulus and be discharged into the cell 114 of the next above segment 100. This process continues until the water has been displaced from within the buoyancy section 70 of the structure 10. With the valves 128, 138 closed, there is no flow of water into or out of the buoyancy section 70 permitted and therefore there is no dynamic water movement inside the cells 114, 116 caused by external water forces acting on the marine structure 10.

Controls tanks 184 located at the top portion of the buoyancy section 70 are tied directly into the double-walled equalized pressure pipes 126 and are used to monitor and adjust the height of the water column 182 within the system. These control tanks 184 contain sensors and switches (not shown) designed to sense and adjust the height of the water column 182. As shown in FIG. 18, the water level 182 within the control tank 184 can be set so that the height of the water column 182 is less than water surface 12 outside the marine structure 10. This setting will create a slight negative differential pressure between the inside of the buoyancy section 70 and the external water pressure at any depth along the length of the buoyancy section 70. This will minimize air leaks out of the buoyancy section 70 through the outer walls of the spar, including cold joints located at the juncture of two segments 208. Water leaking into the buoyancy section 70 through an outer radial wall 110 can cause the water level within the control tank 184 to rise. If the water level reaches high level sensors, water pumps 187 will be switched on lowering the water level to the operational position. If the water level within the control tank 184 begins to drop, this may be read as an indication that air is leaking out of a buoyancy segment 100 allowing water from the column 182 to flow into the segment 100 where the leak is occurring. Once the water level 182 within the control tank 184 drops and reaches low level sensors, an air compressor may be switched on pressurizing the buoyancy section 70 driving out excess water.

METHOD OF CONSTRUCTION

The precast modular marine structure 10 is constructed using assembly line manufacturing techniques at a construction plant 200 which provides a high level of uniformity. The skills required for the crafts to produce the precast modular marine structure 10 are typically available in all countries of the world. If such skills and crafts are not available, each is easily transferable to the local work force.

In one embodiment, the construction plant 200 includes a rebar staging and tying station 212, a forming/casting station 213, an assembly station 215 and a transition station 217. In another embodiment, the construction plant 200 further includes a surge yard 210. In a preferred embodiment, the construction plant 200 includes a form/mold staging area 211, a finishing/outfitting station 214, a post-tensioning station 217 and a transition station 218. In the most preferred embodiment, the construction plant 200 includes a concrete batch plant 193 and a steel fabrication area 194.

Generally, the method of construction involves forming and casting an individual modular component, like a segment 208 or a module 150, in a position, which encourages the pouring and curing of a concrete slurry. After a predetermined period of time, the component is slipped from the mold/form 204. The component typically undergoes a finishing process; installation and tensioning of outer peripheral tendons; and installation of various elements of the marine structure's other systems, such as piping (for the equalized pressure system 170 or other fluid systems), access doors, ladders and electrical conduits. The component is translated into a position conducive for mating with other components. Once the desired components are positioned and mated, tensioning across the mated surfaces is carried out to achieve a unitary structure. Once tensioned, the unitary structure either as a unit 160 or a modular marine structure 10 can be prepared and transitioned to the water itself on a marine transport system, such as a heavy lift vessel/barge.

Segmented Method of Construction

The segmented construction process starts with the pre-tying of reinforcing cages 202 on specially made templates (not shown) designed to match the dimensions of a mold 204, yet facilitate easy entry for workers to tie the reinforcing steel. The cages 202 include post-tension conduits 118, 120, 122 and embedded items. The cages 202 are preferably pre-tied a minimum of one day prior to being transported to and installed in concrete molds 204. This pre-tying facilitates the casting of one segment 208 per mold 204, per day. The pre-tied cages 202 are set into automated concrete molds 204 by a material handling equipment 219. The molds 204 are then closed to a liquid tight fit to facilitate the placement of liquid. Concrete is then poured into the mold 204. The concrete is cured within the mold 204 until it has reached approximately fifty percent of its design strength or approximately twelve hours, at which times the mold 204 is opened, enabling the material handling equipment 219 to lift the segment 208, be it in the form of a buoyancy segment 100 or a ballast segment 130, out of the mold 204.

The segments 208 are moved to a surge yard 210 where they are set onto level footings for final curing. In one embodiment, the double-walled equalized pressure pipes 126, pipe hubs 188, valves 128, 138, sensors, and any other mechanical outfitting are installed in the buoyancy segments 100 while positioned at the surge yard 210. Similar mechanical outfitting is carried out in the ballast segments 130 while positioned at the surge yard 210. Once the segments 208 have reached one hundred percent of their design strength and all mechanical outfitting is completed, they are picked up and transported by the material handling equipment 219 for assembly into modules 150.

In one embodiment, the segments 208 (which are either buoyancy segments 100 or ballast segments 130) are pie-shaped and assembled to form circular-shaped modules 150. The segments 100 or 130 are secured to like adjacent segments 100 or 130 of a module 150 by water resistant, adhesive material 80 that is placed on the contact surfaces of the adjacent segments 100 or 130. Block outs in or pilasters out 140 of the outer radial walls 110 allow circumferential post-tensioning of the module 150 to keep the segments 100 or 130 in place (not shown). Circumferential post-tensioning of the module 150 is accomplished through the use of a plurality of cables routed through conduits 122 and will start at one point and extend 180 degrees around the module 150 in a circumferential overlapping fashion.

A unit 160 is then assembled in the assembly station 216 which can either be on land or on submersible barges. After a module 150 is post-tensioned, it is stacked together with one or more similar modules 150 to form a unit 160. In a unit 160, the segments 100 or 130 are stacked so that the middle tangential walls 104 or 141 are aligned with an outer tangential wall 106 or 139 of upper and/or lower segments to interlock all modules 150 throughout the height of a unit 160. The segments 100 or 130 are aligned on top of other segments by the use of a keyway 124 on the top of the walls of the lower segment. This keyway 124 assures a relatively accurate vertical alignment of the segments 100 or 130. During assembly, all mating surfaces of adjacent segments 100 or 130 and stacked segments 100 or 130 are coated with water resistant adhesive material 80 to join the segments 100 or 130. Post-tensioning about the periphery of each module 150 is conducted in the same manner as for the first module 150. The process of mating modules 150 is repeated until the formed unit 160 reaches a predetermined dimension. The unit 160 is then post-tensioned across the mated modules 150 with strands 121 through pre-installed; post-tension conduits 120 located within the walls of the segments 100 and 130. Only enough conduits 120 to keep the unit 160 together when the unit 160 is translated from the vertical position to a horizontal position are post-tensioned at this time. The remaining conduits 118 are used in post-tensioning after assembling the horizontal units 160 as described later. The unit 160 is post-tensioned with a continuous multiple strand post-tension system. In the preferred process, the marine structure 10 is assembled in the horizontal position. However, the assembly can be accomplished in the vertical position for constructing a marine structure 10.

Figure 22:
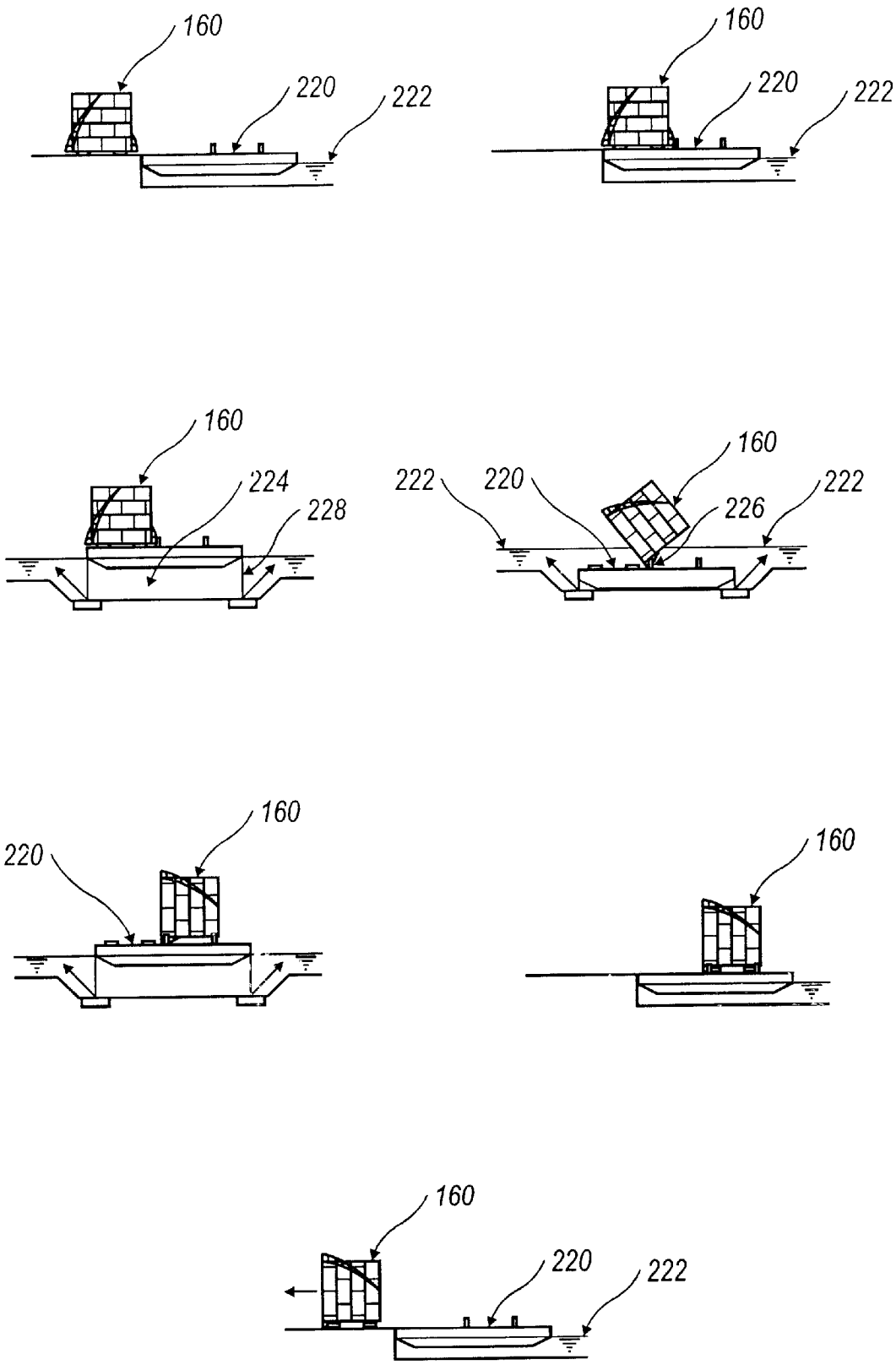
FIG. 22 is an elevational view showing successive steps during one implementation of the method in accordance with the invention.
Figure 23:
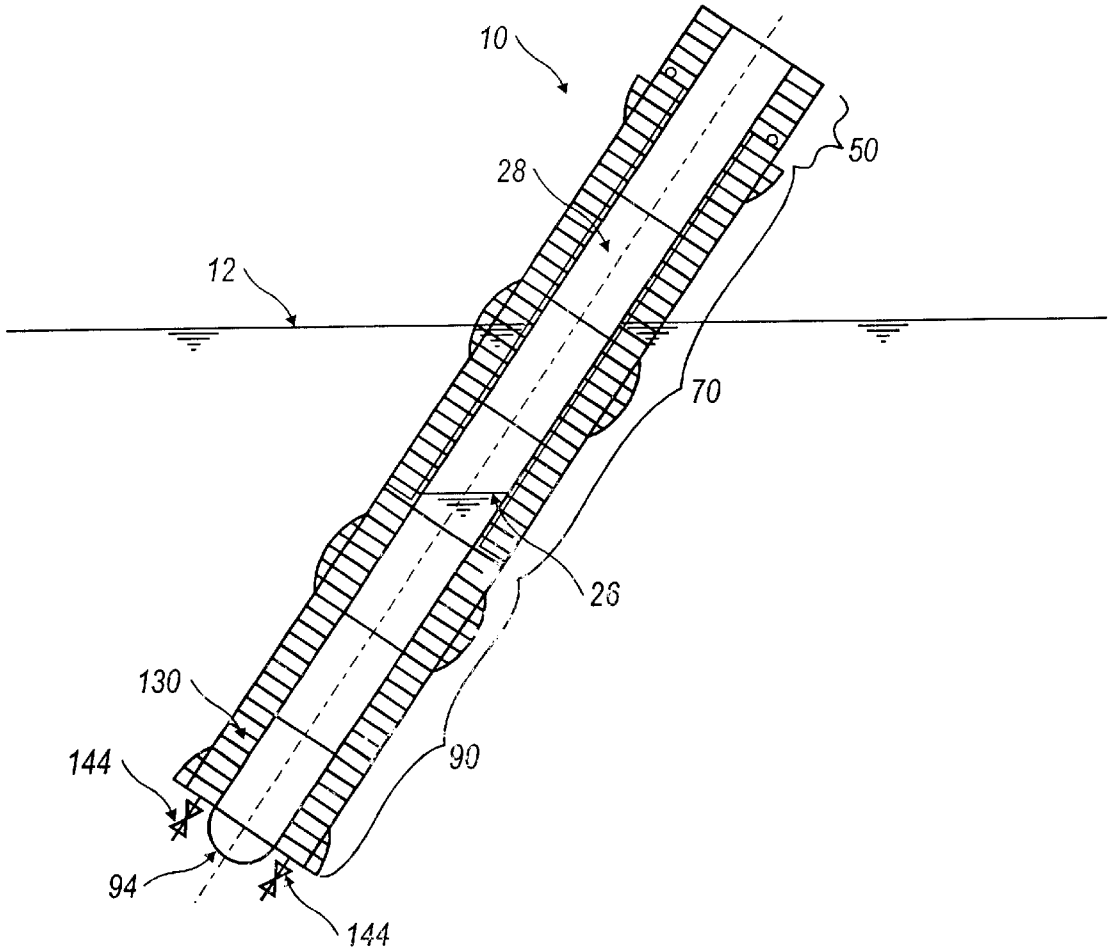
FIG. 23 is a sectional view of the spar as disclosed in FIG. 1 during the upending process.

The assembly of the marine structure 10 can be either on shore or in the water by linking a selected number of units 160 together and then post-tensioning them using a multiple strand post-tensioning system. Turning to FIG. 22, in a preferred process, the units 160 are moved from their vertical position to a horizontal position by using water 222 to upend the units 160. If the unit 160 is assembled on land, the unit 160 is moved to a submersible vessel 220, which is then towed to deep-water site 224. A pivot joint 226 holds the unit 160 securely to the barge 220. Guidelines 228 are attached to the submersible barge 220 at the deep-water site 224 to guide the vessel 220 as it is submerged. Ballast water is used to cause the vessel 220 to submerge. As the vessel 220 descends, the unit 160 is encouraged to float, as shown in FIG. 22. Since the unit 160 is connected to the vessel 220 at the pivot joint 226, it will begin to lie over as the vessel 220 descends. Since the metacentric height of the unit 160 is slightly below its center of gravity, the unit 160 will lay over when the unit 160 reaches its normal buoyancy, at which time the vessel 220 will begin discharging ballast water to ascend. As the vessel 220 ascends, the unit 160 will continue to lie over until it reaches its full horizontal position as shown in FIG. 22. The vessel 220 is then towed to the spar erection site 230 and the unit 160 is moved off the vessel 220.

Figure 19:
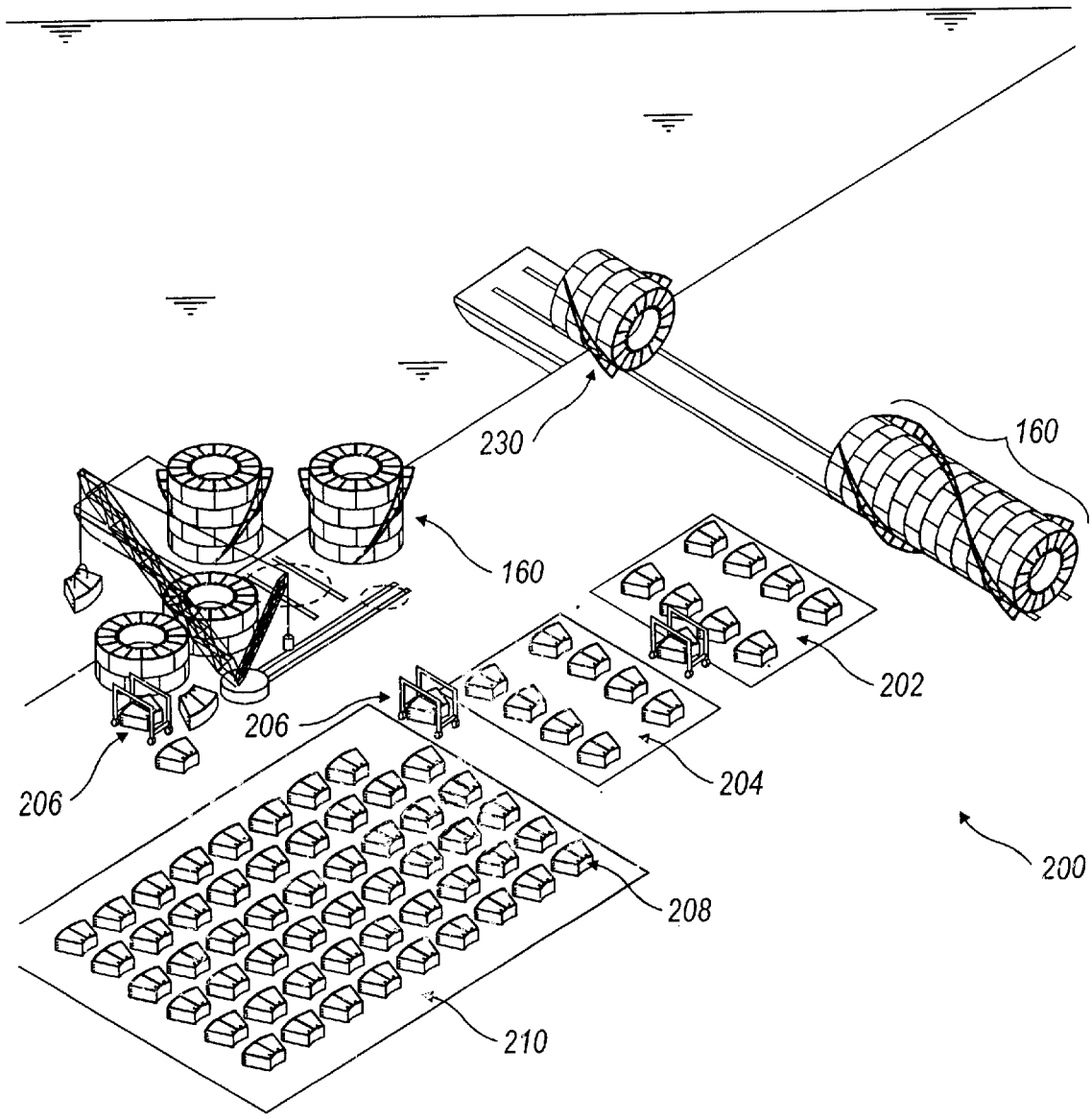
FIG. 19 is an aerial view of a construction plant showing one method of fabricating and erecting the modular pre-cast marine structure.

The unit 160 is then assembled with other units 160 to form the marine structure 10. The number of units used will be selected depending on loading of the marine structure 10 and the water conditions in which marine structure 10 is to be used. A spar type marine structure 10 consisting of eight approximately 100 feet units 160 is depicted in FIGS. 19 and 22. Once all eight units 160 are mated, they are post-tensioned across the mating surfaces by a continuous multi-strand post-tensioning system. The completed marine structure 10 can be transitioned to the water for towing or onto a vessel for further ocean carriage.

Modular Method of Construction

The module construction process starts with either the pre-tying of reinforcing mats/curtains (not shown) on customized templates (not shown) or in situ placement of reinforcing steel inside a module form 205. Pre-tying is better suited when the reinforcing steel total weight is not too heavy and the dimensions are not too large for the material handling equipment and labor of the construction plant 200. The reinforcing mats/curtains, like the reinforcing cages 202, include post-tension conduits 118, 120, 122 and embedded items.

Figure 20:
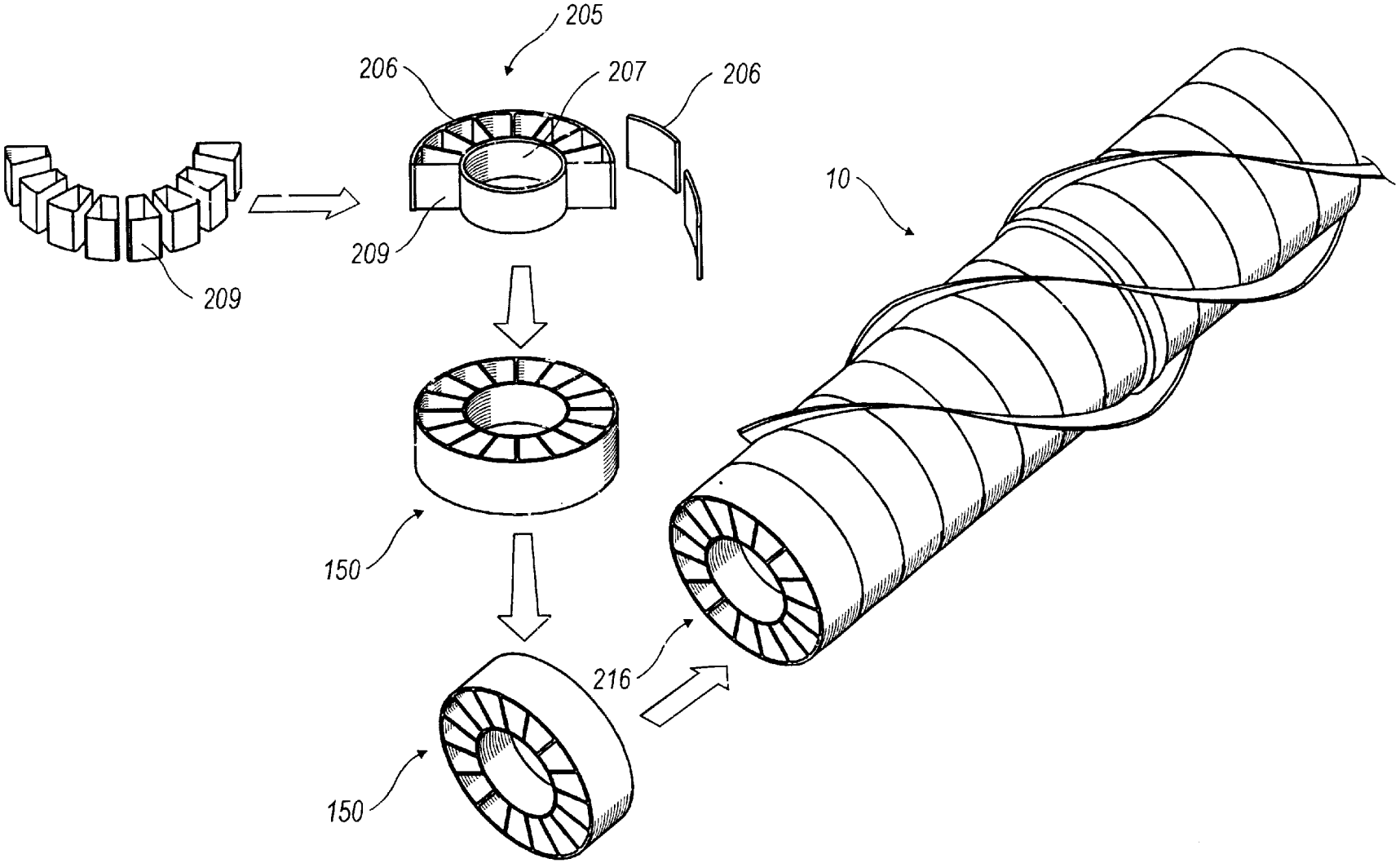
FIG. 20 is a simplified construction flow diagram showing one method of fabricating and erecting the modular pre-cast marine structure.

As depicted in FIG. 20, the module form 205 includes an external form wall 206, an internal form wall 207 and at least two cell inserts 209 spaced apart from each other and positioned between the form walls 206 and 207. In one embodiment, the module form 205 is configured to produce a module 150 for use in the buoyancy section 70 including at least two middle tangential walls 104 connecting a portion of an outer radial wall 110 to a portion of an inner radial wall 112 and a top slab 102 connectively extending across the walls. Where the module 150 is intended to be used in the ballast section 90, the module for 205 is configured to produce at least two middle tangential walls 141 connecting a position an outer radial wall 110 to a portion of an inner radial wall 112 and a top slab 132 connectively extending across the walls.

Figure 21:
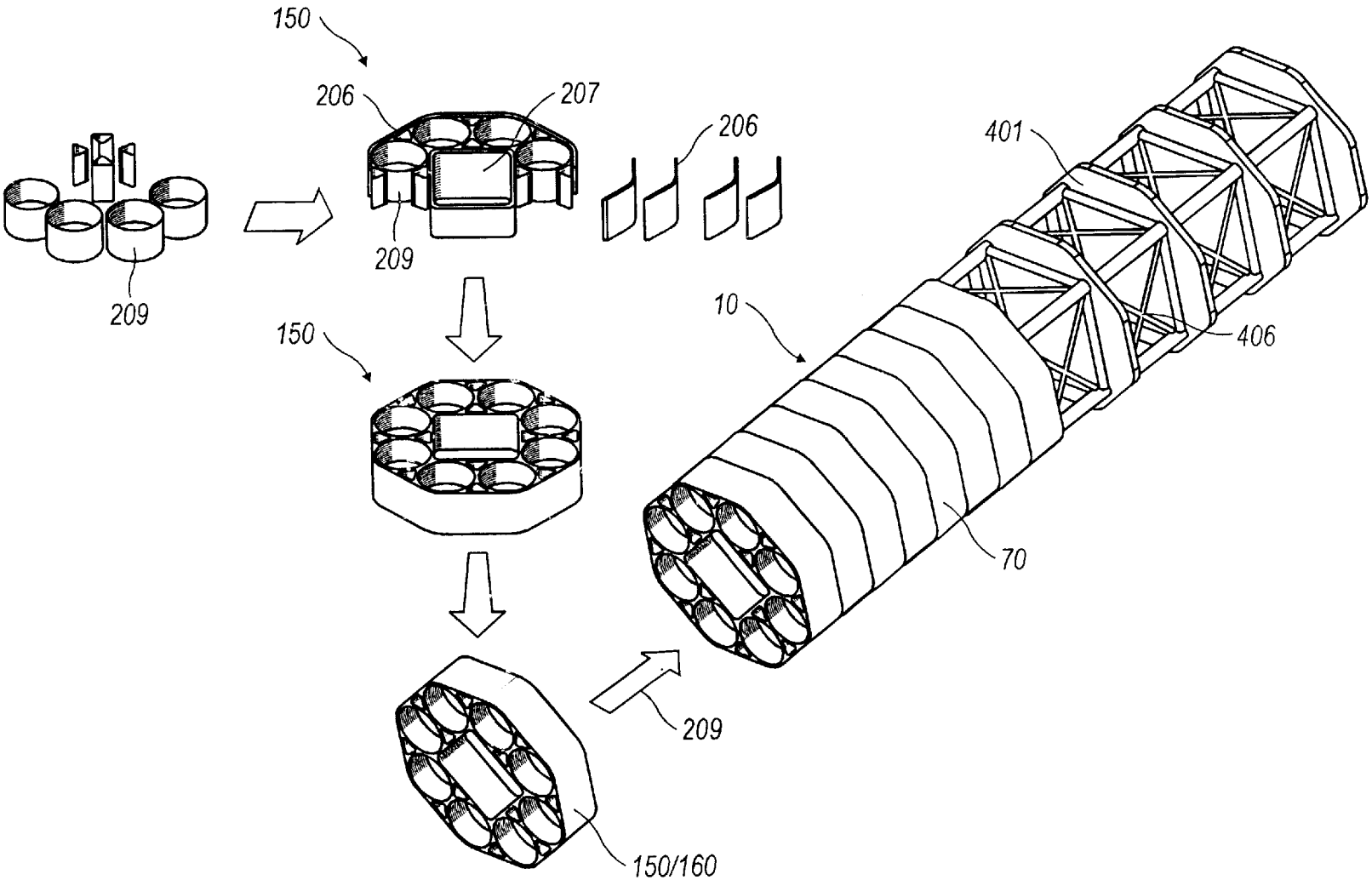
FIG. 21 is a simplified construction flow diagram showing one method of fabricating and erecting the truss spar disclosed in FIG. 4.

In one embodiment, the modular form 205 is configured to produce substantially circular outer and inner radial walls 110 and 112 (See FIG. 20). In an alternative embodiment, the modular for 205 is configured to produce substantially polygonal outer and inner radial walls 110 and 112 (See FIG. 21). In another embodiment, the modular form 205 is configured to produce at least two inner tangential walls with furcated ends (See FIG. 21).

Once configured, the module form 205 is closed to a liquid tight fit to facilitate the pouring and retention of a liquid, which sets up and solidifies over time, such as concrete. In a preferred embodiment, concrete is poured into the module form 205 and encouraged to fill the empty spaces formed by the form walls 206 and 207 and the cell inserts 209.

The concrete is cured within the module form 205 until it has reached approximately fifty percent of its design strength or approximately twenty-four hours. Thereafter, the module form 205 is released and stripped away by material handling equipment, leaving behind a module 150 suitably shaped for use in the buoyancy section 70 or the ballast section 90.

The module 150 is moved to a finishing and outfitting station 214. In one embodiment, the equalized pressure system 170, valves 128, 138, sensors, and any other mechanical outfitting are installed in modules 150 to be used in the buoyancy section 70. Similar mechanical outfitting is carried out in modules 150 to be used in the ballast section 90. Once the modules 150 have reached one hundred percent of their design strength and all mechanical outfitting is completed, each are post-tensioned about their circumference. Block outs in or pilasters out 140 of the outer radial walls 110 allow circumferential post-tensioning of the module 150.

The modules 150 are then transported to a station for translation from a position conducive for casting to a position conducive for mating and/or tensioning similar modules 150 together. In a preferred process, each module 150 is moved from their vertical position to a horizontal position by using material handling equipment, such as strand jack lifters positioned on top of vertical towers, to upend the modules 150 into a position which is conducive to mating the modules 150.

Upon completion of the upending process, the module 150 is transferred to the assembly station for alignment, mating and grouting to other modules 150. The modules 150 are aligned to an adjacent module by the use of a keyway 124 on the end of the modules 150. This keyway 124 assures a relatively accurate alignment of the modules. During assembly, all mating surfaces of adjacent modules 150 are coated with water resistant adhesive material 80 to join the modules 150.

The process of mating modules 150 is repeated until the formed unit 160 reaches a predetermined dimension. The unit 160 is then post-tensioned across the mated modules 150 with strands 121 through pre-installed, post-tension conduits 120 located within the radial walls 110 and 112 of the module 150. Only enough strands 121 and conduits 120 to keep the unit 160 together during the mating process are post-tensioned. The remaining tendons 121 and conduits 118 are used in post-tensioning after the complete assembly of the modules 150 into a unit 160 which becomes the modular marine structure 10. It should be noted that modular assembly could be accomplished in the vertical position for constructing a marine structure 10.

Like the segmented method of construction, the unit 160 is assembled with other units 160 to form the marine structure 10. The number of units 160 used will be selected depending on loading of the marine structure 10 and the water conditions in which marine structure 10 is to be used. Once the pre-determined number of units 160 are mated, they are post-tensioned across the mating surfaces by a continuous multi-strand post-tensioning system. Once post-tensioned, the completed marine structure 10 can be transitioned to the water for towing or onto a vessel for further ocean carriage.

While there are several different types of materials, which could be used in constructing the marine structure 10, in the preferred embodiment the following materials are preferred. The material used for casting is high strength concrete with a varying density and compressive strength. The reinforcing steel is grade 40 steel or better. The multi-strand post-tensioning system uses 0.5" or 0.6" diameter 7 wire, uncoated, stress-relieved or low relaxing grade T70 strands. The post-tensioning strands are housed within the plastic post-tension conduits and grouted after tensioning to bond the strands to the structure for added corrosive protection of the strands.

The marine structure which includes a truss ballast section 91 calls for constructing the buoyancy section 70 according to one of the construction methods set forth above. The truss 400 is constructed in a construction plant (not shown) utilizing similar construction methods as steel jacket fabrication. The riser tubes 402 are pre-tensioned at the construction plant so that the truss 400, when linked to at least one module 150, is always in compression with the bottom of the module 150. The modules 150 are linked and post-tensioned to each other in a horizontal position.

INDUSTRIAL APPLICABILITY

The present invention finds particular applicability in the marine industries, but may be utilized in any environment in which a buoyant vessel is required to be taken underwater across variable depths while desirable maintaining substantially similar internal and external pressures.

What is claimed and desired to be secured by Letters Patent is as follows:

1. A marine structure for use with an equalized pressure system comprising:

a structure having an outer wall of uniform thickness and at least one cell, and said equalized pressure system having a controllable pressurized fluid source fluidly coupled to said at least one cell and to a body of water adjacent to said marine structure to vary the buoyancy of said marine structure;

said marine structure comprises a payload platform, a freeboard section, a buoyancy section and a ballast section, said ballast section being operatively mounted to said buoyancy section and said freeboard section supporting said payload platform; and said buoyancy and ballast sections comprise a top slab, at least two tangential walls, at least one outer radial wall, at least one inner radial wall and at least two cells, said outer radial wall and said inner radial wall connecting to said tangential walls forming said at least two cells, and said top slab extends across said walls.

2. The marine structure as recited in claim 1, further comprising keyways mounted on said buoyancy section to facilitate alignment and stacking.

3. The marine structure as recited in claim 1, wherein said tangential walls have furcated end portions forming said at least two cells in arcuate shapes.

4. The marine structure in claim 1, wherein said ballast section comprises a truss, at least one riser tube and at least one flat; said at least one pretensioned riser tube connected to said truss and said at least one flat; said at least one pretensioned riser tube extends through at least a significant portion of said buoyancy section and securingly attached to at least one truss support beam to compress said buoyancy section against said ballast section.

5. The marine structure as recited in claim 4, wherein said at least one truss support beam is located at an upper region of said buoyancy section to transfer compressive forces into said buoyancy section.

6. The marine structure as recited in claim 4, further comprising at least one alignment pin securingly positioned between said buoyancy section and said ballast section to promote alignment of said compressed sections and to at least significantly reduce lateral movement between said sections.

7. The marine structure as recited in claim 1, further comprising a plurality of mooring lines secured by anchors at one of their ends to the sea floor and secured at another end to said marine structure to effectively transfer forces between said mooring lines and a region near a center of rotation of said marine structure.

8. The marine structure as recited in claim 7, wherein said plurality of mooring lines extend and connect to mooring windlasses fixed to said marine structure.

9. The marine structure as recited in claim 7, further comprising a plurality of tethers secured at one of their ends to said plurality of mooring lines and secured at another end to said marine structure to effectively transfer forces between said mooring lines and a lower region of said marine structure.

10. The marine structure as recited in claim 9, wherein said plurality of tethers extend and connect to tether windlasses.

11. The marine structure as recited in claim 1, further comprises a skirt foundation having an open void facing a seabed, said skirt foundation securingly attached to said marine structure below said ballast section; said skirt foundation penetrates and anchors said marine structure to said seabed when a buoyannt force of said marine structure is reduced.

12. The marine structure as recited in claim 11, wherein a fluid pressure system is operably connected to said open void to remove upper layers of said seabed from inside said skirt foundation.

13. The marine structure as recited in claim 12, wherein said fluid pressure system is capable of pumping dense fluids into said open void.

14. The marine structure as recited in claim 12, wherein said fluid pressure system is an equalized pressure system.

15. The marine structure as recited in claim 11, wherein said equalized pressure system comprises a fluid inlet and a fluid conduit, wherein said fluid inlet fluidly couples said controllable pressurized fluid source to said cell and said fluid conduit fluidly couples said cell to said adjacent body of water to allow fluid passage between said cell and said adjacent body of water.

16. The marine structure as recited in claim 15, wherein an opening near an end said fluid conduit is adjustably positioned within said cell to control the buoyant force of said cell.

17. The marine structure as recited in claim 1, wherein at least two cells are fluidly connected to said adjacent body of water by a segmented substantially vertical water column.

18. A marine structure for use with an equalized pressure system comprising:

a structure having an outer wall of uniform thickness and at least one cell, and said equalized pressure system having a controllable pressurized fluid source fluid coupled to said at least one cell and to a body of water adjacent to said marine structure to vary the buoyancy of said marine structure;

said marine structure comprises a payload platform, a freeboard section, a buoyancy section and a ballast section, said ballast section being operatively mounted to said buoyancy section and said freeboard section supporting said payload platform;

said buoyancy and ballast sections comprise a top slab, at least two tangential walls, at least one outer radial wall, at least one inner radial wall and at least two cells, said outer radial wall and said inner radial wall connecting to said tangential walls forming said at least two cells, and said top slab extends across said walls; and said top slab of said ballast section has a passageway receivingly disposed through said top slab of said ballast section.

19. The marine structure as recited in claim 18, wherein said top slab is fitted with trim valves to control the movement of ballast water within said ballast section.

20. A marine structure for use with an equalized pressure system comprising:

a marine structure having an outer wall of uniform thickness and at least one cell;

said equalized pressure system having a controllable fluid source fluidly coupled to said cell and to a body of water adjacent to said marine structure to vary the buoyancy of said marine structure, wherein at least two cells are fluidly connected to said adjacent body of water by a segmented vertical water column; and said segmented substantially vertical water column is contained within a plurality of fluid conduits connecting at least two adjacent cells.

21. A marine structure for use with an equalized pressure system comprising:

a marine structure having an outer wall of uniform thickness and at least one cell;

said equalized pressure system having a controllable fluid source fluidly coupled to said cell and to a body of water adjacent to said marine structure to vary the buoyancy of said marine structure, wherein at least two cells are fluidly connected to said adjacent body of water by a segmented vertical water column; and wherein said segmented substantially vertical water column is contained within a plurality of double-walled pipes connecting at least two adjacent cells.

22. The marine structure as recited in claim 21, wherein said fluid source is fluidly connected to said cells by said double-walled pipes.

23. A marine structure for use with an equalized pressure system comprising:

a marine structure having an outer wall of uniform thickness and at least one cell;

said equalized pressure system having a controllable fluid source fluidly coupled to said cell and to a body of water adjacent to said marine structure to vary the buoyancy of said marine structure, wherein at least two cells are fluidly connected to said adjacent body of water by a segmented vertical water column; and said equalized pressure system further comprises at least one pump of sufficient capacity to change level of said segmented water column thereby controlling the buoyant force of said marine structure.

24. A marine structure for use with an equalized pressure system comprising:

a marine structure having an outer wall of uniform thickness and at least one cell;

said equalized pressure system having a controllable fluid source fluidly coupled to said cell and to a body of water adjacent to said marine structure to vary the buoyancy of said marine structure, wherein at least two cells are fluidly connected to said adjacent body of water by a segmented vertical water column; and said equalized pressure system further comprises a control system to sense and change the level of said segmented water column by controlling at least one pump of sufficient capacity to change said level thereby controlling a buoyant force of said marine structure.

25. The marine structure as recited claim 24, wherein said control system further controls said fluid source to change said level thereby controlling said buoyant force.

26. A marine structure for use with an equalized pressure system comprising:

a structure having an outer wall of uniform thickness and at least one cell;

said equalized pressure system having a controllable gas source fluidly coupled to said cell, said cell fluidly coupled by a conduit to a body of water adjacent to said marine structure, said gas source being of sufficient quantity to balance internal and external pressure of said marine structure;

said marine structure comprises a payload platform, a modular freeboard section, a modular buoyancy section and a modular ballast section, said modular ballast section being operatively mounted to said modular buoyancy section and said modular freeboard section supporting said payload platform; and said ballast section comprises a truss, at least one riser tube and at least one flat; said at least one riser tube being connected to said truss and said at least one flat; said at least one riser tube extending through at least a significant portion of said buoyancy section and being securingly attached to at least one truss support beam.

27. A marine structure for use with an equalized pressure system comprising:

a structure having an outer wall of uniform thickness and at least one cell;

said equalized pressure system having a controllable gas source fluidly coupled to said cell, said cell fluidly coupled by a conduit to a body of water adjacent to said marine structure, said gas source being of sufficient quantity to balance internal and external pressure of said marine structure;

said marine structure comprises a payload platform, a modular freeboard section, a modular buoyancy section and a modular ballast section, said modular ballast section being operatively mounted to said modular buoyancy section and said modular freeboard section supporting said payload platform;

said ballast section comprises a truss, at least one riser tube and at least one flat; said at least one riser tube being connected to said truss and said at least one flat; said at least one riser tube extending through at least a significant portion of said buoyancy section and being securingly attached to at least one truss support beam; and said at least one truss support beam is located at an upper region of said buoyancy section to transfer compressive forces into said buoyancy section.

28. A marine structure for use with an equalized pressure system comprising:

a structure having an outer wall of uniform thickness and at least one cell;

said equalized pressure system having a controllable gas source fluidly coupled to said cell, said cell fluidly coupled by a conduit to a body of water adjacent to said marine structure, said gas source being of sufficient quantity to balance internal and external pressure of said marine structure;

said marine structure comprises a payload platform, a modular freeboard section, a modular buoyancy section and a modular ballast section, said modular ballast section being operatively mounted to said modular buoyancy section and said modular freeboard section supporting said payload platform;

said ballast section comprises a truss, at least one riser tube and at least one flat; said at least one riser tube being connected to said truss and said at least one flat; said at least one riser tube extending through at least a significant portion of said buoyancy section and being securingly attached to at least one truss support beam; and at least one alignment pin securingly positioned between said buoyant section and said ballast section to align said sections during construction and further promote alignment and simultaneously significantly reduce lateral movement between said sections during operations.

29. A marine structure for use with an equalized pressure system comprising:

a structure having an outer wall of uniform thickness and at least one cell;

said equalized pressure system having a controllable gas source fluidly coupled to said cell, said cell fluidly coupled by a conduit to a body of water adjacent to said marine structure, said gas source being of sufficient quantity to balance internal and external pressure of said marine structure;

said at least one cell having a fluid inlet and a fluid conduit, wherein said fluid inlet fluidly couples said controllable gas source to said at least one cell and said fluid conduit fluidly couples said cell to said adjacent body of water to allow fluid passage between said at least one cell and said adjacent body of water; and said fluid conduit is adjustably positioned within said at least one cell to control the internal pressure of said at least one cell.

* * * * *